US007155145B2

(12) United States Patent
Iwasaki et al.

(10) Patent No.: US 7,155,145 B2
(45) Date of Patent: Dec. 26, 2006

(54) IMAGE FORMING APPARATUS HAVING DRIVE SECTION COUPLED WITH IMAGE BEARING BODY

(75) Inventors: Takahiro Iwasaki, Hachioji (JP); Jun Onishi, Hachioji (JP); Toru Makino, Hachioji (JP); Naoto Tokutake, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 249 days.

(21) Appl. No.: 10/851,909

(22) Filed: May 21, 2004

(65) Prior Publication Data

US 2005/0025523 A1 Feb. 3, 2005

(30) Foreign Application Priority Data

| | | |
|---|---|---|
| Jul. 28, 2003 | (JP) | 2003-202328 |
| Sep. 4, 2003 | (JP) | 2003-312375 |
| Feb. 20, 2004 | (JP) | 2004-043794 |
| Feb. 20, 2004 | (JP) | 2004-043817 |

(51) Int. Cl.
*G03G 15/00* (2006.01)

(52) U.S. Cl. ..... 399/167

(58) Field of Classification Search ..... 399/167, 399/298, 299, 302

See application file for complete search history.

(56) References Cited

U.S. PATENT DOCUMENTS

| | | | | |
|---|---|---|---|---|
| 5,128,715 A * | 7/1992 | Furuyama et al. | 399/116 |
| 5,669,046 A * | 9/1997 | Yoshida et al. | 399/167 |
| 5,993,101 A * | 11/1999 | Kohno et al. | 403/305 |
| 6,397,029 B1 * | 5/2002 | Portig | 399/167 |
| 6,714,752 B1 * | 3/2004 | Ueno et al. | 399/117 |
| 6,788,909 B1 * | 9/2004 | Prichett | 399/117 |

FOREIGN PATENT DOCUMENTS

| | | |
|---|---|---|
| JP | 09319238 A * | 12/1997 |
| JP | 11303883 A * | 11/1999 |
| JP | 2000-112194 | 4/2000 |
| JP | 2002357986 A * | 12/2002 |

* cited by examiner

*Primary Examiner*—Robert Beatty
(74) *Attorney, Agent, or Firm*—Cantor Colburn LLP

(57) ABSTRACT

An image forming apparatus having: a plurality of image bearing bodies on each of which a toner image is formed; a plurality of drive sections for rotating the plurality of image bearing bodies; a carrying section for carrying a transfer medium; and a transfer section for superposing each of the toner images formed on each of the image bearing bodies onto the transfer medium to transfer, wherein each of the drive sections is coupled with each of the image bearing bodies by a coupling comprising a drive section side coupling portion and an image bearing body side coupling portion which are formed to be engagable with each other, and at least one of the drive section side coupling portion and the image bearing side coupling portion is freely engaged with a rotary shaft for transmitting a torque from each of the drive sections to each of the image bearing bodies.

19 Claims, 19 Drawing Sheets

IN A CASE THAT CLEARANCE IS LARGE

IMAGE FORMING APPARATUS HAVING DRIVE SECTION COUPLED WITH IMAGE BEARING BODY

BACKGROUND OF THE INVENTION

1. Field of the Invention

The present invention relates to a technique for preventing rotation error of an image bearing body in an image forming apparatus, or a technique for preventing color drift when transferring a toner image for each color formed by each of a plurality of image bearing bodies onto a transfer medium such as an intermediate transfer body or the like.

2. Description of the Related Art

A color image forming apparatus comprises image bearing bodies for original colors of yellow (Y), magenta (M), cyan (C) and black (K), in which a toner image for each color formed on each image bearing body is superposed on an intermediate transfer body, and a toner image with four colors superposed is transferred onto a transfer paper to form a color image.

Each image bearing body forms an image forming section comprising a charging device, a developing device, a transferring device, a cleaning device and the like, and each image forming section for each color and the intermediate transfer body form a process cartridge as a unit. The process cartridge is withdrawable from the body of the image forming apparatus, and each image bearing body, developing device or the like can be attached to or detached from the process cartridge in a state in which the process cartridge is withdrawn.

The toner image for each color formed in each image forming section is transferred onto the rotating intermediate transfer body by the transfer device in order to form a composite color image. A toner image needs to be superposed with a previous image corresponding thereto for forming a color image with no color drift.

For this purpose, linear velocities of the image bearing body and a transfer medium such as the intermediate transfer body are required to correspond to one another with high accuracy. Difference between the linear velocities would cause color drift or image drift.

Each image bearing body is provided with a drive device to be driven. The drive device transmits rotation which was slowed down through a plurality of gears from a main motor to a rotary shaft. The rotary shaft is capable of inserting through the cylindrical image bearing body from one side, and is supported by a bearing provided on the opposite side to rotate the image bearing body.

As described above, the image bearing body receives the rotation from the main motor through a train of gears comprising a plurality of gears, so that high accuracy is required for each gear, however, slight rotation error occurs due to accumulated tolerance of the gears. Rotation error occurs even to the intermediate bearing body which is driven in the same manner as the image bearing body. Thus, rotation error would occur even when adjusting linear velocities of the image bearing body and the intermediate transfer body, thereby causing image drift.

An image forming apparatus disclosed in JP-Tokukai-2000-112194A has a coupling shape in which a bearing of a large gear is engaged with an engaging part of an engaging member of an image bearing body, and transmission of rotation from a rotary shaft to the image bearing body is performed by directly coupling a large gear to the rotary shaft. In such configuration, transmission of the rotation from the main motor to the image bearing body is slowed down through the large gear, intending to improve rotation error by using less number of gears to reduce the influence of accumulated tolerance.

Although rotation error can be improved, it does not become zero. In a color image forming apparatus, rotation error occurs even in the intermediate transfer body, so that the above described configuration would fail to prevent rotation error which occurs while transferring an image onto the intermediate transfer body.

SUMMARY OF THE INVENTION

The present invention is developed in view of the above described point, and an object of the present invention is to provide an image forming apparatus comprising an image bearing body which is capable of reducing rotation error of the image bearing body or keeping a linear velocity approximately equal to that of a transfer medium such as an intermediate transfer body.

For solving the problems, in accordance with a first aspect of the present invention, an image forming apparatus comprises:

a plurality of image bearing bodies on each of which a toner image is formed;

a plurality of drive sections for rotating the plurality of image bearing bodies;

a carrying section for carrying a transfer medium; and a transfer section for superposing each of the toner images formed on each of the image bearing bodies onto the transfer medium to transfer, wherein each of the drive sections is coupled with each of the image bearing bodies by a coupling comprising a drive section side coupling portion and an image bearing body side coupling portion which are formed to be engagable with each other, and at least one of the drive section side coupling portion and the image bearing side coupling portion is freely engaged with a rotary shaft for transmitting a torque from each of the drive sections to each of the image bearing bodies.

According to the image forming apparatus, for transmitting rotation of a motor or the like to the image bearing body through a train of gears or the like, the drive section such as a motor and the image bearing body are coupled by the coupling. Since the coupling has allowance, rotation error is not deteriorated even when error such as recentering occurs between a drive shaft and a driven member.

In accordance with a second aspect of the present invention, an image forming apparatus comprises:

an image bearing body on which a toner image is formed; and a drive section for rotating the image bearing body, wherein the drive section is coupled with the image bearing body by a coupling comprising a drive section side coupling portion and an image bearing body side coupling portion which are formed to be engagable with each other, and at least one of the drive section side coupling portion and the image bearing side coupling portion is freely engaged with a rotary shaft for transmitting a torque from the drive section to the image bearing body.

In a case of a color image forming apparatus, a plurality of image bearing bodies are provided, and a toner image on each image bearing body is transferred to a transfer medium such as an intermediate transfer body or the like. In the transferring operation, both of them closely contact with each other, however, rotation error would occur to the drive section of each image bearing body or to the intermediate transfer body. Even in such the case, rotation error of the image bearing bodies can be suppressed to be small by the allowance of the coupling, so that the image bearing bodies can follow the transfer medium. Thus, the image bearing bodies and the transfer medium can rotate at the same linear velocity, thereby preventing the occurrence of color drift.

Preferably, at least one of the drive section side coupling portion and the image bearing body side coupling portion comprises a hollow cylindrical portion, an inside of which is formed in a hollow cylindrical shape, and a clearance provided between the hollow cylindrical portion and the rotary shaft is set to be larger than an accumulated amount of tolerance of an inner diameter of the hollow cylindrical portion and an outer diameter of the rotary shaft, wherein the clearance is represented by the following equation:

$$\phi D-\phi d$$

where $\phi D$ represents the inner diameter of the hollow cylindrical portion, and $\phi d$ represents the outer diameter of the rotary shaft.

The apparatus may further comprise a fixing portion for fixing the coupling to the rotary shaft, and a plurality of fixed portions to which the fixing portion may be fixed, wherein a clearance may be provided between the fixing portion and the plurality of fixed portions, and the fixing portion may come into contact with the plurality of fixed portions at two points or more at the same time, when transmitting a torque from the drive section.

When the fixing portion is freely fixed to the fixed portions, the plurality of fixed portions can come into contact with the fixing portion at least at one point in transmitting rotation from one coupling to the other, however, two points contact cannot be accomplished in view of positions or processing accuracy. The rotation center of the image bearing body is different from the center of the rotary shaft or the coupling due to the weight of a cleaning blade or its own weight. Therefore, one point contact would cause displacement of the rotation center, thereby making rotation error large. Contrary to this, in the image forming apparatus of the present invention, the fixing portion and the fixed portions can come into contact with one another at two points or more at the same time because the rotary shaft is freely engaged with the coupling as well as that the fixing portion is freely fixed to the fixed portions. Thus, occurrence of displacement of rotation center can be prevented, thereby counteracting rotation error.

Since the difference between the inner diameter of the hollow cylindrical portion and the outer diameter of the rotary shaft ($\phi D-\phi d$) is larger than the accumulated amount of parts tolerance of the fixing portion and the fixed portions, the fixing portion can come into contact with the fixed portions at two points or more at the same time. Thus, occurrence of displacement of rotation center can be prevented, thereby counteracting rotation error.

Preferably, the fixing portion comprises both end portions of a pin which passes through the rotary shaft to be fixed, the plurality of fixed portions comprise two long holes which are formed in the coupling to face each other, and when the both end portions of the pin are inserted into the long holes and a relative rotation is applied between the coupling and the rotary shaft, each of the both end portions of the pin comes into contact with a side surface of each of the long holes.

The pin is attached to the rotary shaft so as to pass therethrough so that both ends of the pin protrude the rotary shaft, and the both ends of the pin are also inserted through the long holes of the coupling. The diameter of the pin is smaller than the width of the long holes so that there is a clearance provided between the pin and each long hole. When a relative rotation is applied between the coupling and the rotary shaft, each ends of the pin moves in each long hole in the opposite direction. Since there is a clearance between the rotary shaft and the hollow cylindrical portion as well as the clearance between the pin and each long hole, the pin can come into contact with the side surfaces of the long holes at the same time, thereby preventing displacement of the rotation center. Accordingly, rotation error can be reduced.

Preferably, at least one of the drive section side coupling portion and the image bearing body side coupling portion comprises a hollow cylindrical portion, an inside of which is formed in a hollow cylindrical shape, and a clearance provided between the hollow cylindrical portion and the rotary shaft is set to be larger than an accumulated amount of tolerance of an outer diameter of the pin and the widths of the long holes, wherein the clearance is represented by the following equation:

$$\phi D-\phi d$$

where $\phi D$ represents the inner diameter of the hollow cylindrical portion, and $\phi d$ represents the outer diameter of the rotary shaft.

Since the clearance ($\phi D-\phi d$) is set to be larger than the accumulated amount of parts tolerance of the two contacting portions at which the pin and the rotary shaft contact with each other, where $\phi D$ is an inner diameter of the hollow cylindrical portion of the one coupling and $\phi d$ is an outer diameter of the rotary shaft, the pin can come into contact with the rotary shaft at two points or more at the same time. Thus, occurrence of displacement of rotation center can be prevented, thereby counteracting rotation error.

Preferably, one of the drive section side coupling portion and the image bearing side coupling portion comprises a plurality of convexities extending in an axis direction of the rotary shaft, the other thereof comprise a plurality of concavities with which the plurality of convexities are freely engaged, and the plurality of convexities come into contact with the plurality of concavities at two points or more at the same time, when transmitting a torque from the drive section.

The plurality of convexities formed in the coupling are freely engaged with the plurality of concavities formed in the other coupling to be coupled. The convexities can contact with the concavities at two points or more at the same time by the clearances between the convexities and the concavities, and between the hollow cylindrical portion and the rotary shaft. Thus, occurrence of displacement of rotation center can be prevented, thereby counteracting rotation error.

Preferably, at least one of the drive section side coupling portion and the image bearing body side coupling portion comprises a hollow cylindrical portion, an inside of which is formed in a hollow cylindrical shape, and a clearance provided between the hollow cylindrical portion and the rotary shaft is set to be larger than an accumulated amount of tolerance of the convexities and the concavities in the rotation direction of the rotary shaft, wherein the clearance is represented by the following equation:

$$\phi D-\phi d$$

where $\phi D$ represents an inner diameter of the hollow cylindrical portion, and $\phi d$ represents an outer diameter of the rotary shaft.

Since the clearance ($\phi D-\phi d$) is set to be larger than the accumulated amount of parts tolerance of a plurality of contacting portions of the concavities and the convexities, the concavities can come into contact with the convexities at two points or more at the same time. Thus, occurrence of displacement of rotation center can be prevented, thereby counteracting rotation error.

Preferably, the plurality of convexities form pawls, and the plurality of concavities form gaps between the pawls.

Both of the couplings comprise the same shaped pawls, so that convexities and concavities can be formed, thereby making the structure simple.

Preferably, at least one contact surface at which one of the convexities contact with one of the concavities is formed in a plane which includes a central axis of the coupling, when transmitting a torque from the drive section.

A central axis of the coupling may be included in an extended surface of at least one contact surface at which one of the convexities contact with one of the concavities, when transmitting a torque from the drive section.

Preferably, each of the drive section side coupling portion and the image bearing body side coupling portion comprises a hollow cylindrical portion, and the rotary shaft is inserted through each the hollow cylindrical portion.

In accordance with a third aspect of the present invention, an image forming apparatus comprises:

an image bearing body on which a toner image is formed; and a drive section for rotating the image bearing body, wherein the drive section is coupled with the image bearing body by a coupling comprising a drive section side coupling portion and an image bearing body side coupling portion which are formed to be engagable with each other, and at least one of a first contact surface of the drive section side coupling portion which contacts with the image bearing body side coupling portion and a second contact surface of the image bearing body side coupling portion which contacts with the drive section side coupling portion is formed in a curved surface.

Preferably, one of the first and second contact surfaces is formed in a curved surface, and the other thereof is formed in a flat surface.

Preferably, the curved surface comprises a cylindrical surface or a spherical surface.

The apparatus may further comprise: a plurality of image bearing bodies; a carrying section for carrying a transfer medium to which toner images formed on the image bearing bodies are transferred; and a transfer section for superposing each of the toner images formed on each of the image bearing bodies onto the transfer medium to transfer.

At least one of the drive section side coupling portion and the image bearing side coupling portion may be freely engaged with the rotary shaft for transmitting a torque from the drive section to the image bearing body.

Preferably, at least one of the drive section side coupling portion and the image bearing body side coupling portion comprises a hollow cylindrical portion, an inside of which is formed in a hollow cylindrical shape, the rotary shaft is inserted through the hollow cylindrical portion, one of the drive section side coupling portion and the image bearing side coupling portion comprises a plurality of convexities extending in an axis direction of the rotary shaft, the other thereof comprise a plurality of concavities with which the plurality of convexities are freely engaged, the plurality of convexities come into contact with the plurality of concavities at two points or more at the same time when transmitting a torque from the drive section, and a central axis of the coupling is included in an extended surface of at least one contact surface at which one of the convexities is engaged with one of the concavities.

In accordance with a fourth aspect of the present invention, an image forming apparatus comprises:

an image bearing body on which a toner image is formed; and a drive section for rotating the image bearing body, wherein the drive section is coupled with the image bearing body by a coupling comprising a drive section side coupling portion and an image bearing body side coupling portion which are formed to be engagable with each other, and at least one of a first contact portion of the drive section side coupling portion which contacts with the image bearing body side coupling portion and a second contact portion of the image bearing body side coupling portion which contacts with the drive section side coupling portion has an elasticity.

Preferably, the drive section side coupling portion and the image bearing side coupling portion comprise a plurality of first and second contact portions, respectively, and the first and second contact portions contact with one another at two points or more, when transmitting a torque from the drive section.

Preferably, the at least one of the first and the second contact portions with an elasticity has a bending flexibility factor of 1.3% to 4% when a bending stress is 40 to 60 Mpa.

Preferably, the at least one of the first and the second contact portions with an elasticity may comprise a polyacetal.

The apparatus may further comprise: a plurality of image bearing bodies; a carrying section for carrying a transfer medium to which toner images formed on the image bearing bodies are transferred; and a transfer section for superposing each of the toner images formed on each of the image bearing bodies onto the transfer medium to transfer.

Preferably, at least one of the drive section side coupling portion and the image bearing side coupling portion is freely engaged with the rotary shaft for transmitting a torque from the drive section to the image bearing body.

Preferably, at least one of the drive section side coupling portion and the image bearing body side coupling portion comprises a hollow cylindrical portion, an inside of which is formed in a hollow cylindrical shape, the rotary shaft is inserted through the hollow cylindrical portion, one of the drive section side coupling portion and the image bearing side coupling portion comprises a plurality of convexities extending in an axis direction of the rotary shaft, the other thereof comprise a plurality of concavities with which the plurality of convexities are freely engaged, the plurality of convexities come into contact with the plurality of concavities at two points or more at the same time when transmitting a torque from the drive section, and a central axis of the coupling is included in an extended surface of at least one contact surface at which one of the convexities is engaged with one of the concavities.

BRIEF DESCRIPTION OF THE DRAWINGS

The present invention will become more fully understood from the detailed description given hereinafter and the accompanying drawings which are given by way of illustration only, and thus are not intended as a definition of the limits of the present invention, and wherein.

DETAILED DESCRIPTION OF THE PREFERRED EMBODIMENTS

Figure 1:
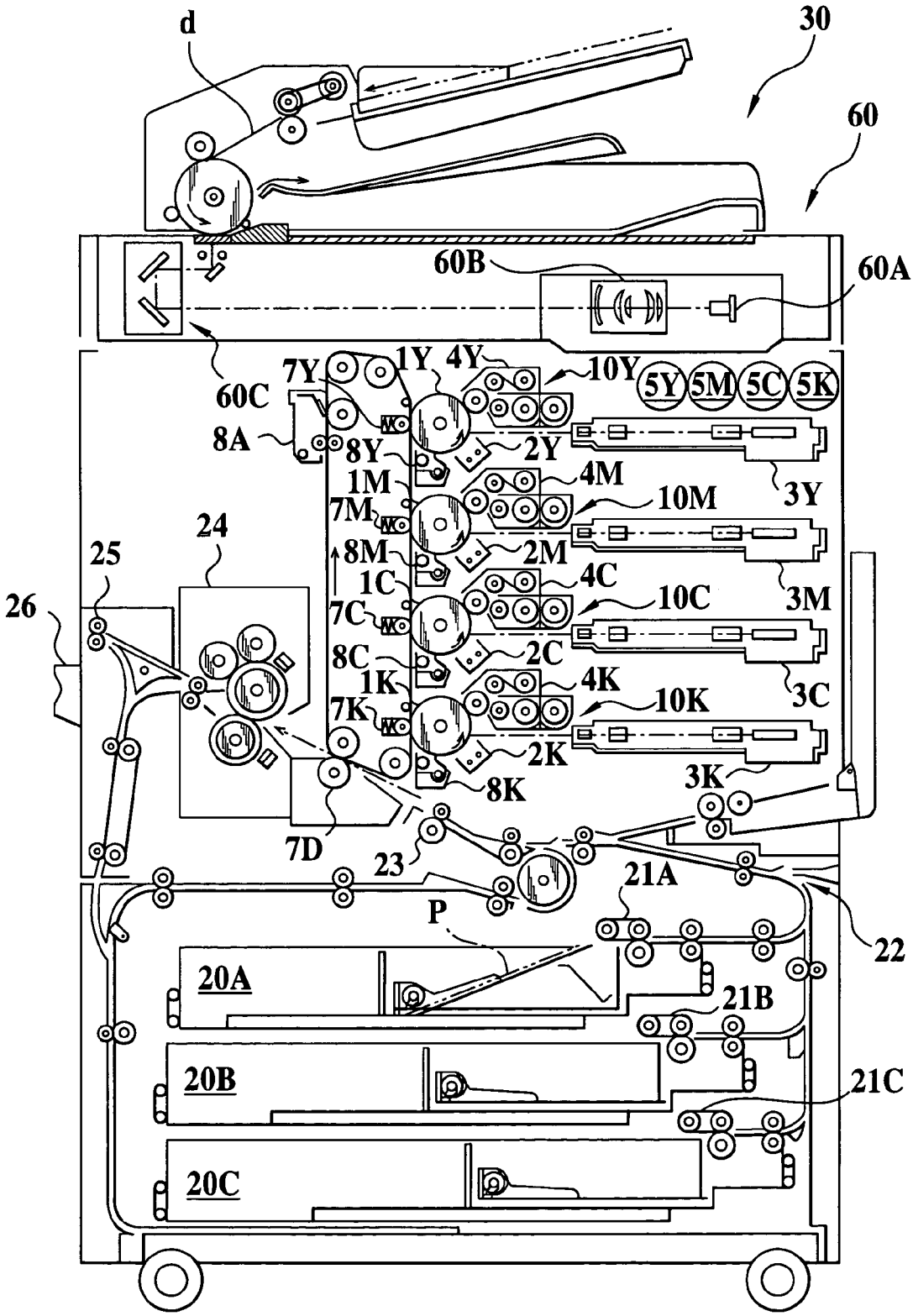
FIG. 1 is a view showing a color image forming apparatus of the embodiment in the present invention.

Embodiments of the present invention will be explained below referring to the drawings.

FIG. 1 is a view showing a color image forming apparatus of the embodiment in the present invention. The color image forming apparatus shown in FIG. 1 is referred to as a tandem type color image forming apparatus, and comprises an automatic document carrying section 30, an image reading device 60, image writing devices 3Y, 3M, 3C, 3K, image bearing bodies 1Y, 1M, 1C, 1K, charging devices 2Y, 2M, 2C, 2K, developing devices 4Y, 4M, 4C, 4K, a fixing device 24, an endless belt-like intermediate transfer body 6, a paper supplying sections 21A, 21B, 21C, a carrying system 22, and the like.

The automatic document carrying section 30 is a section to automatically carry a document d which is recorded on both sides or a single side. The image reading device 60 is a device capable of reading image information by a movable optical system, in which contents of a plurality of documents d fed from a platen glass are reflected by three movable mirror 60C, and focused on an imaging device 60A comprising CCD by a condenser lens 60B to be read.

An image forming portion 10Y for forming a yellow color image comprises the charging device 2Y arranged around the image bearing body 1Y as an image forming body, the image writing device 3Y, the developing device 4Y and a cleaning device 8Y. An image forming portion 10M for forming a magenta color image comprises the image bearing body 1M as an image forming body, the charging device 2M, the image writing device 3M, the developing device 4M and a cleaning device 8M. An image forming portion 10C for forming a cyan color image comprises the image bearing body 1C as an image forming body, the charging device 2C, the image writing device 3C, the developing device 4C and a cleaning device 8C. An image forming portion 10K for forming a black color image comprises the image bearing body 1K as an image forming body, the charging device 2K, the image writing device 3K, the developing device 4K and a cleaning device 8K. Each combination of the charging device 2Y and the image writing device 3Y, the charging device 2M and the image writing device 3M, the charging device 2C and the image writing device 3C, and the charging device 2K and the image writing device 3K comprises a latent image forming section.

The endless belt-like intermediate transfer body 6 is tensioned and rotatably supported by a plurality of rollers.

Image information signals focused on the imaging device 60A are transferred to an image processing portion which is not shown. The image processing portion transfers signals for each of the colors to the image writing devices 3Y, 3M, 3K, respectively, after performing A/D conversion, shading correction, image compression processing or the like.

Each of the image writing devices 3Y, 3M, 3C, 3K uses a semiconductor laser as a laser light source, in which light beam emitted from the semiconductor laser is formed into scanning light beam by an optical element such as a polygon mirror, entering into the image bearing bodies 1Y, 1M, 1C, 1K as a body to be scanned, and thereby an electrostatic latent image for each color is formed. These images are developed by the developing devices 4Y, 4M, 4C, 4K to form a tone image on the image bearing bodies 1Y, 1M, 1C, 1K, respectively.

The image of each color formed by each of the image forming portions 1Y, 10M, 10C and 10K is continuously transferred onto the rotating intermediate transfer body 6 by each of transfer devices 7Y, 7M, 7C, 7K as a primary transfer device (primary transfer), and thereby a composite color image is formed. Recording papers P contained in paper supplying cassettes 20A, 20B, 20C are supplied by paper supplying sections 21A, 21B, 21C, respectively, and then carried to a transfer device 7D as a secondary transfer device via the carrying system 22 while adjusting timing by a resist roller 23 to form a color image onto a recording paper P (secondary transfer). The recording paper P with a color image transferred is subjected to a fixing treatment by the fixing device 24, and then held by a discharge roller 25 to be discharged onto a discharge tray 26.

After transferring a color image onto the recording paper P by the transfer device 7D, the intermediate transfer body 6 from which the recording paper P was separated is subjected to cleaning by the cleaning device 8A.

Toner supplying sections 5Y, 5M, 5C, 5K are for supplying new toner to the developing devices 4Y, 4M, 4C, 4K, respectively.

Figure 2:
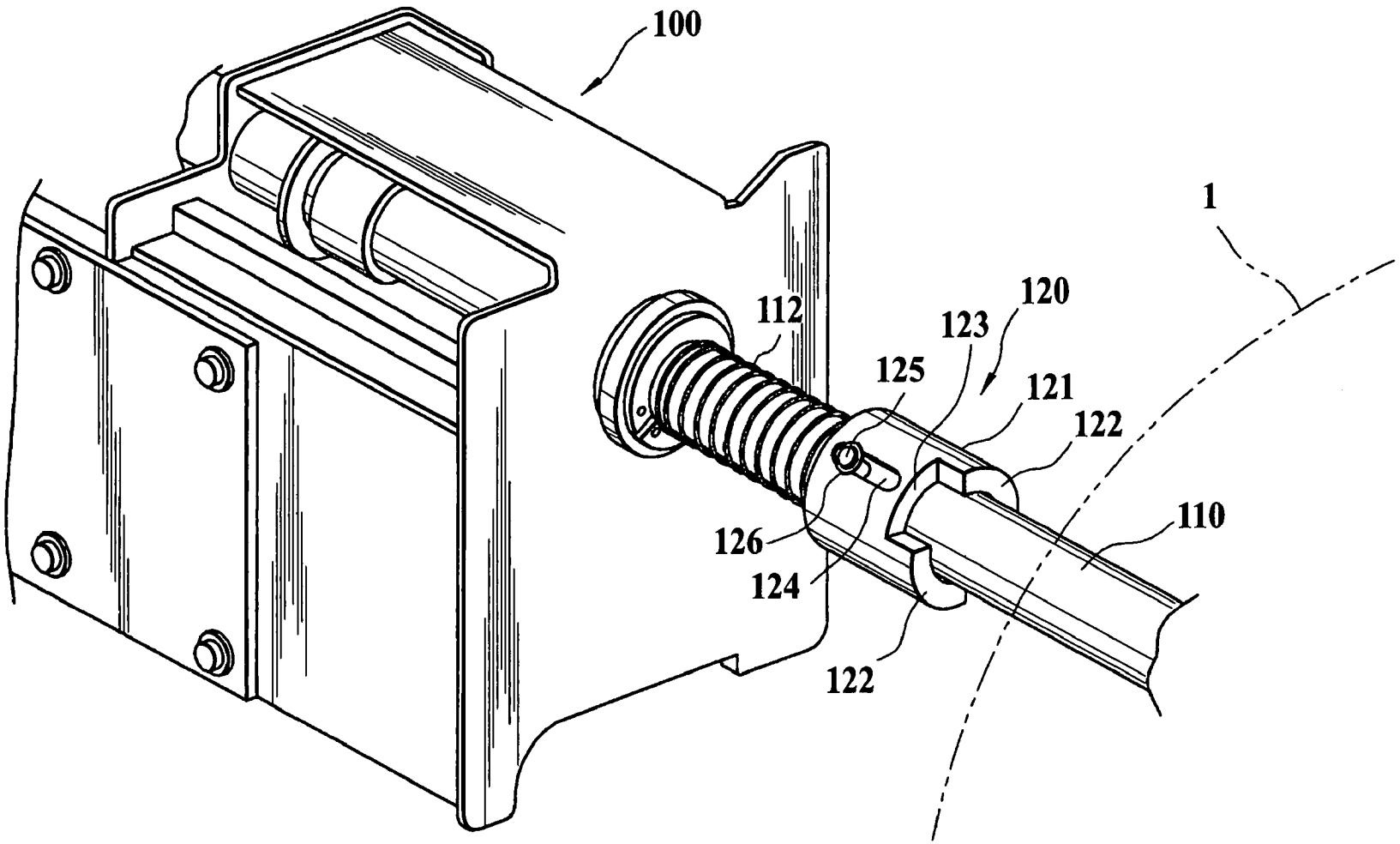
FIG. 2 is a perspective view showing a portion from a drive section of an image bearing body to a drive section side coupling.
Figure 3:
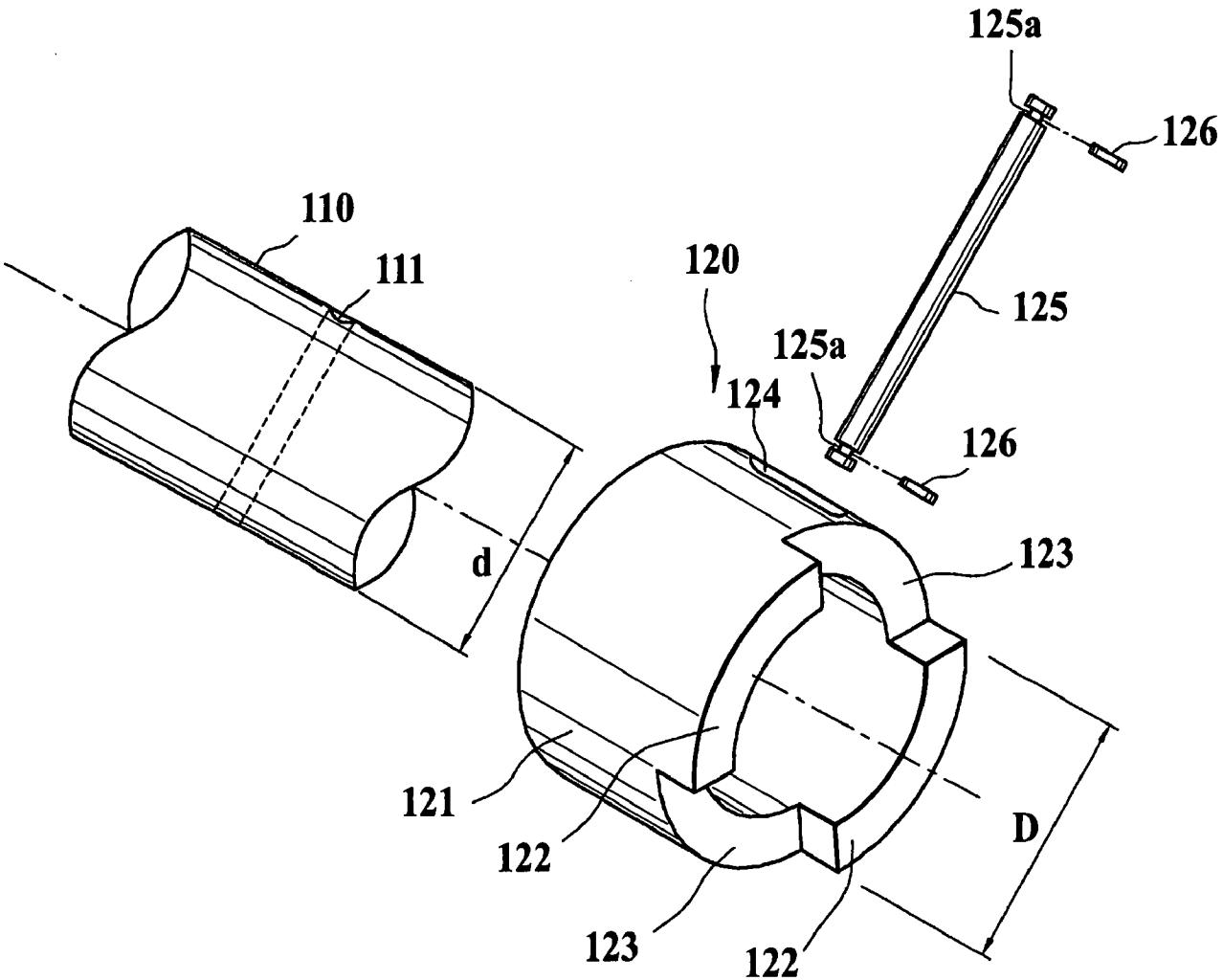
FIG. 3 is a broken perspective view showing a portion around the drive section side coupling in FIG. 2 from a different angle.

FIG. 2 is a perspective view showing a portion from a drive section of an image bearing body 1 (indicating any one of the image bearing bodies 1Y, 1M, 1C, 1K) to a drive section side coupling. FIG. 3 is a broken perspective view showing a portion around the drive section side coupling in FIG. 2 from a different angle. Contained in a drive section 100 is a train of gears or the like, which is rotated by a main motor (not shown) to transmit a rotation which was slowed down to a rotary shaft 110.

A drive section side coupling 120 is attached to the rotary shaft 110, in which pawls 122, 122 as convexities are formed facing each other at one end side of a hollow cylindrical portion 121. Two concavities 123, 123 are formed between the pawls 122, 122. There is formed long holes 124 extending in an axis direction in the hollow cylindrical portion 121 to pass through the hollow cylindrical portion 121. A through hole 111 is formed in the rotary shaft 110 to align with the long holes 124. The rotary shaft 110 is inserted into the drive section side coupling 120 from the tip thereof so that the through hole 111 is aligned with the long holes 124. Then, a pin 125 is inserted into the through hole 111 to make both ends of the pin 125 protrude from both sides of the drive section side coupling 120. The pin 125 is adjusted so that grooves 125*a*, 125*a* at both ends of the pin 125 are approximately equal to the height of the outer peripheral surface of the hollow cylindrical portion 121. Thereafter, E rings 126, 126 are engaged with the grooves 125*a*, 125*a*, respectively, so that the drive section side coupling 120 is fixed to the rotary shaft 110 as shown in FIG. 2.

A coil spring 120 is put on the rotary shaft 110 before inserting the drive section side coupling 120 so that when the drive section side coupling 120 is engaged with an image bearing body side coupling 130, the coil spring 120 is powered to keep the coupling state of the both couplings.

Figure 4:
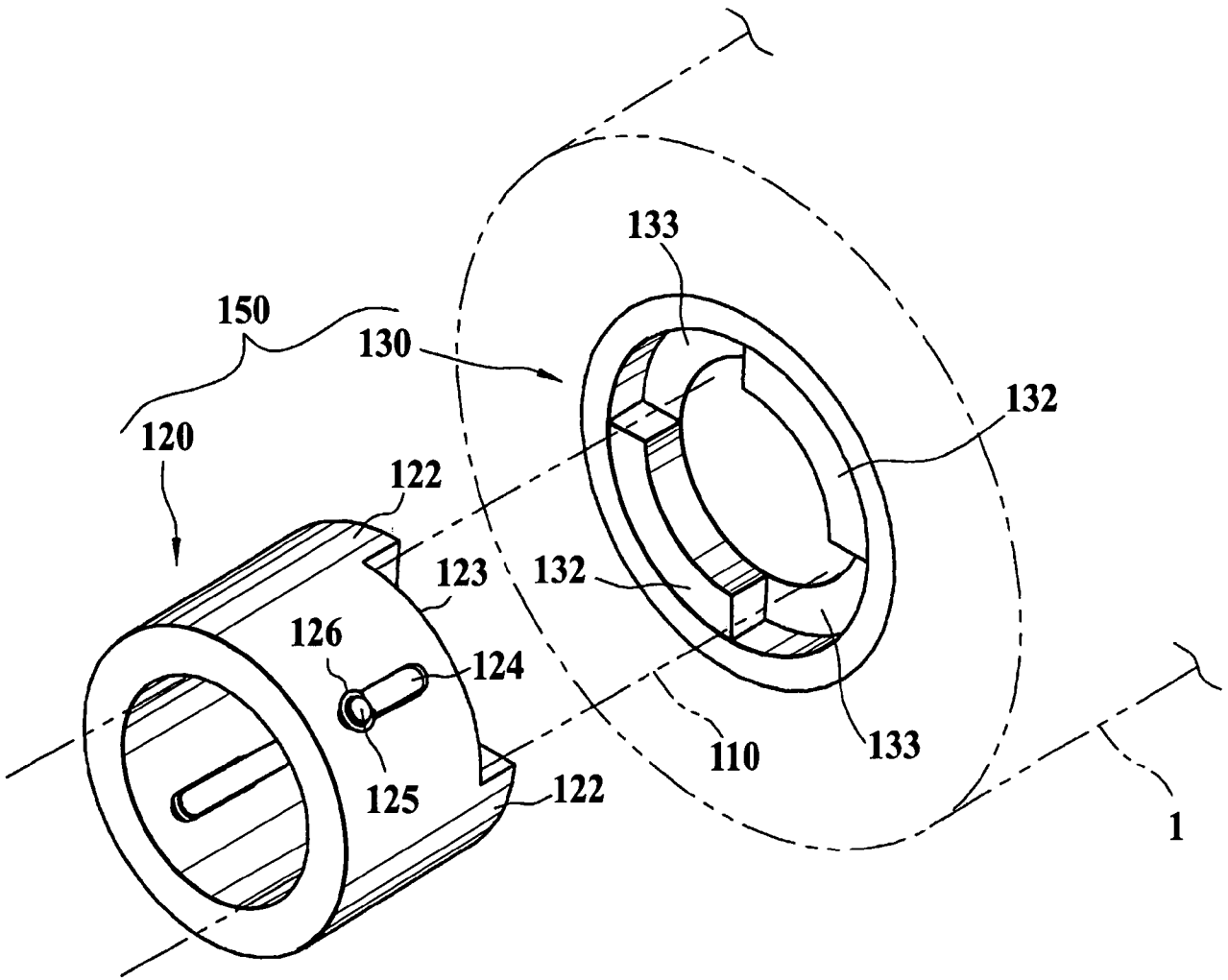
FIG. 4 is a perspective view showing a coupling comprising the drive section side coupling and an image bearing body side coupling before engaged.

FIG. 4 is a perspective view showing a coupling 150 comprising the drive section side coupling 120 and the image bearing body side coupling 130 before engaged. In FIG. 4, the rotary shaft 110 is shown in virtual lines so that the structure of the image bearing body coupling 130 is easily recognized.

The image bearing body side coupling 130 made of metal has a complementary structure of the drive section side coupling 120, and is engaged with the cylindrical shaped image bearing body 1 at both ends thereof to be united. That is, the image bearing body side coupling 130 is provided with two pawls 132, 132 as convexities and two concavities 133, 133 formed therebetween. The pawls 132, 132 are engaged with the concavities 123, 123 of the drive section side coupling 120, respectively, and the concavities 133, 133 are engaged with the pawls 122, 122 of the drive section side coupling 120.

Figure 5A:
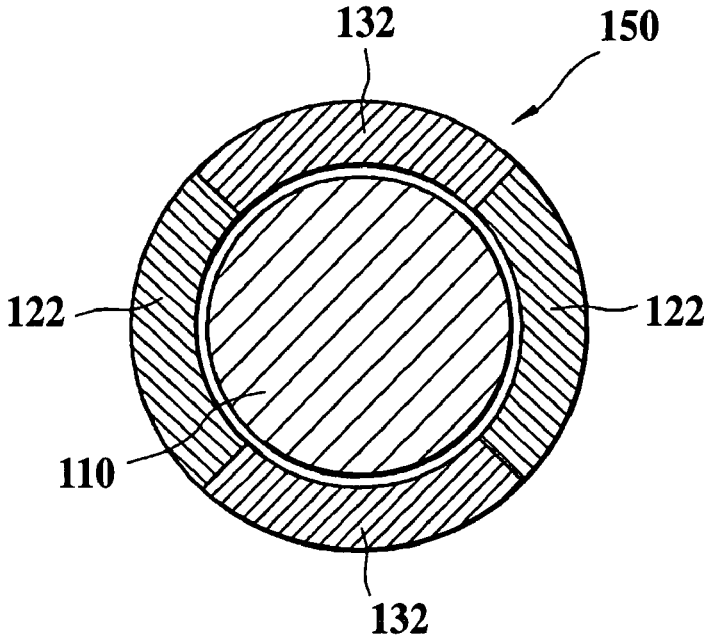
FIG. 5A is a sectional view at a portion of pawls of the both couplings in a state in which the couplings are engaged.
Figure 5B:
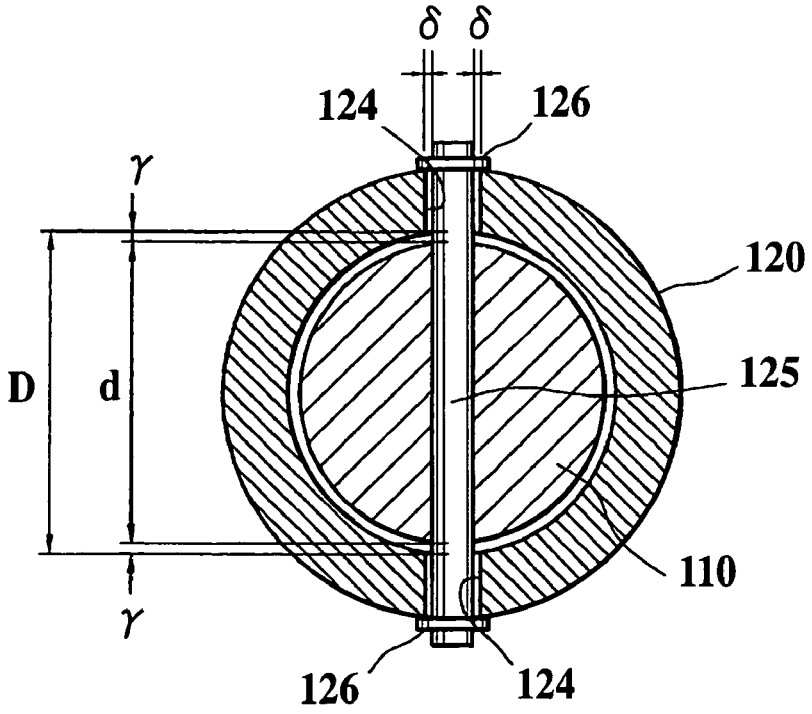
FIG. 5B is a sectional view at a portion of a pin in a state in which the couplings are engaged.

FIGS. 5A and 5B are views showing the coupling 150 engaged. FIG. 5A is a sectional view at a portion of the pawls 122, 132 of the both couplings, and FIG. 5B is a sectional view at a portion of the pin 125. The rotary shaft 110 is inserted into a central hole of the image bearing body side coupling 130 for engaging the coupling 150. The rotary shaft 110 is passed through the cylindrical shaped image bearing body 1. Thereafter, one of the rotary shaft 110 and the image bearing body 1 is rotated for aligning the positions of the pawls 122 of the drive section side coupling 120 and the pawls 132 of the image bearing body side coupling 130 to be engaged. After engaging the coupling 150, the tip of the rotary shaft 110 protruding from the opposite side of the image bearing body 1 is engaged with a bearing (not shown) provided on a frame for axially supporting the image bearing body 1. The drive section side coupling 120 moves back and forth along the long holes 124 by the biasing force of the coil spring 112, enabling the coupling 150 to keep the state of engagement.

In a coupling of an earlier technique, when the both couplings are engaged, there is no clearance at each engaged portion of the pawls 122, 132 and the concavities 123, 133, the long hole 124 and the pin 125, and the rotary shaft 110 and the both couplings 120, 130.

Contrary to this, the embodiment has a feature that the coupling 150 is engaged with allowance. That is, the long holes 124 are freely engaged with the pin 125, and the drive section side coupling 120 is freely engaged with the rotary shaft 110. The above description will be explained in detail below.

As shown in FIG. 5A, the pawls 122 of the drive section side coupling 120 are engaged with the pawls 132 of the image bearing body side coupling 130 with no clearance, which is the same as the coupling of the earlier technique.

Contrary to this, as shown in FIGS. 5A and 5B, there is a relation $D=d+2\gamma$ between a hole diameter D of the drive section side coupling 120 and a diameter d of the rotary shaft 110, where $\gamma$ is a clearance (one side) provided. As shown in FIG. 5B, there is a clearance $\delta$ on one side between the pin 125 and the long hole 124. In this embodiment, there is provided such the clearances $\gamma$, $\delta$ in the coupling 150 to be in freely engaged state.

The clearances $\gamma$, $\delta$ are successful in counteracting rotation error of the rotation transmitted to the rotary shaft 110 from the drive section 100, the rotation error being caused by various reasons such as pitch error of the gears. Description will be made in more detail below.

Figure 6A:
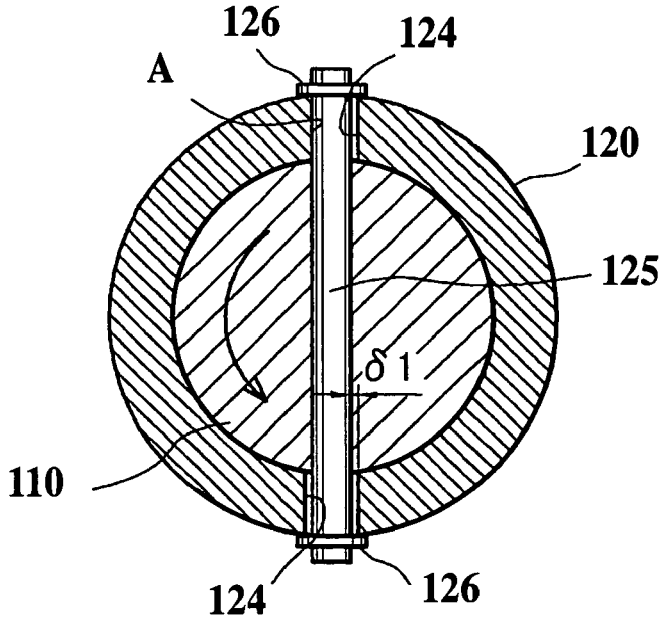
FIG. 6A is a sectional view at a portion of the pin in a case that a clearance $\gamma \approx 0$.

FIG. 6A shows a case where $\gamma \approx 0$. The clearance between the rotary shaft 110 and the drive section side coupling 120 is substantially "0", however, they are mutually rotatable. In FIG. 6A, when the rotary shaft 110 is slightly rotated counterclockwise with respect to the drive section side coupling 120, one fixing portion, that is, an upper end of the pin 125 contacts with the side surface of the long hole 124 as a fixed portion, however, the other fixing portion, that is, a lower end of the pin 125 is in a state of being separated from both side surfaces of the long hole 124, due to variations of positions or processing accuracy. The error at the fixing portion caused by accumulated parts tolerance due to variations of positions or processing accuracy is defined as $\delta 1$. The fixing portion contacting with the fixed portion at one point would cause displacement of the rotation center to thereby enlarge the rotation error. When the coupling has a small clearance, such the one point contact tends to occur.

The rotation center of the image bearing body 1 is different from that of the rotary shaft 110 or the coupling 150 due to weight of a cleaning blade or its own weight. When a clearance is small, only one of two transmitting points is used, thereby causing displacement of the rotation center of the image bearing body 1, and deteriorating rotation error.

Contrary to this, since there is a diameter difference 2γ satisfying the condition of 2δ<2γ between the rotary shaft 110 and the drive section side coupling 120, the rotary shaft 110 moves inside of the drive section side coupling 120, enabling the upper end of the pin 125 as a fixing portion to contact with the left side surface B of the long hole 124 as a fixed portion, and the lower end of the pin 125 as the other fixing portion to contact with the right side surface B' of the long hole 124. The two fixing portions contact with the fixed portions at the same time, respectively, so that displacement of the rotation center is prevented, thereby suppressing rotation error. Hereupon, δ is set corresponding to δ1 in FIG. 6A, where δ1≦δ.

Figure 6B:
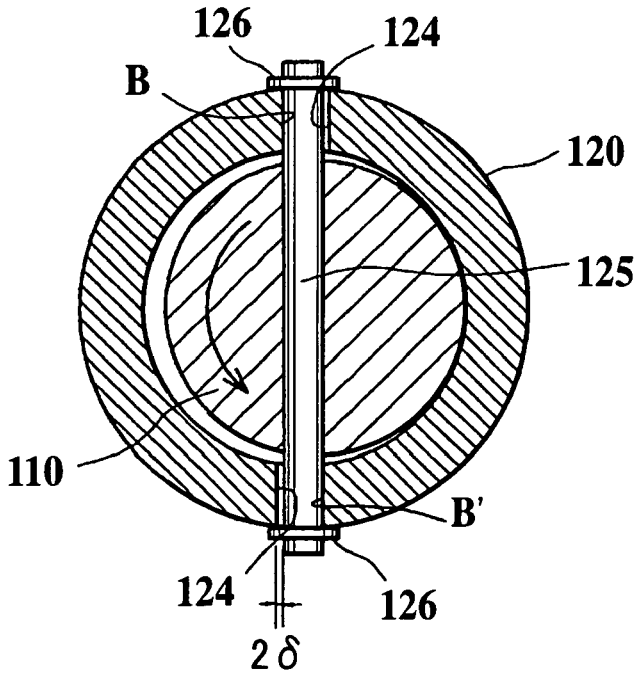
FIG. 6B is a sectional view at a portion of the pin in a case that a clearance $\gamma$ exists.

In FIG. 6B, 2γ is set to be larger than the accumulated amount of parts tolerance of the hole diameter of the drive section side coupling 120 and the diameter of the rotary shaft 110, so that when displacement occurs between. the axis centers of the coupling 150 and the rotary shaft 110 in rotation, two of the fixing portions properly contact the fixed portions at the same time, thereby suppressing rotation error more reliably as shown in FIG. 6B.

Figure 7A:
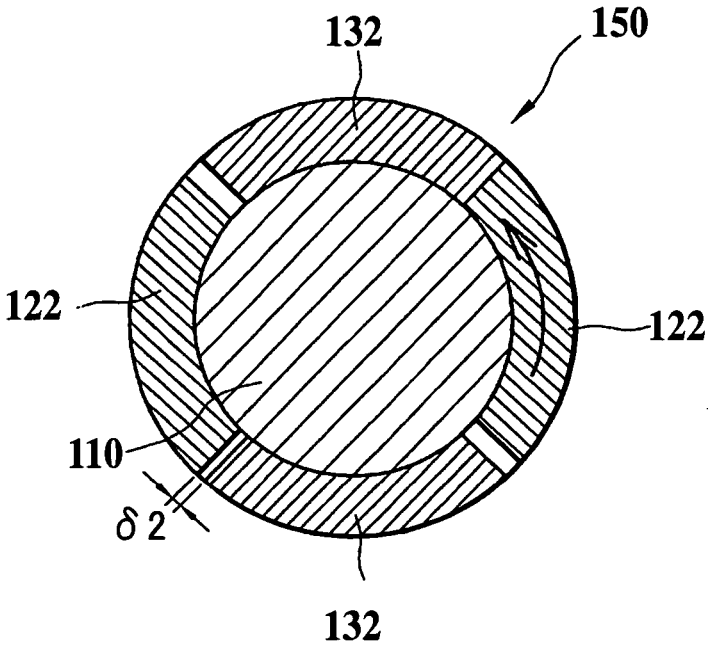
FIG. 7A is a sectional view at a portion of pawls in a state in which the couplings of an earlier technique are engaged.
Figure 7B:
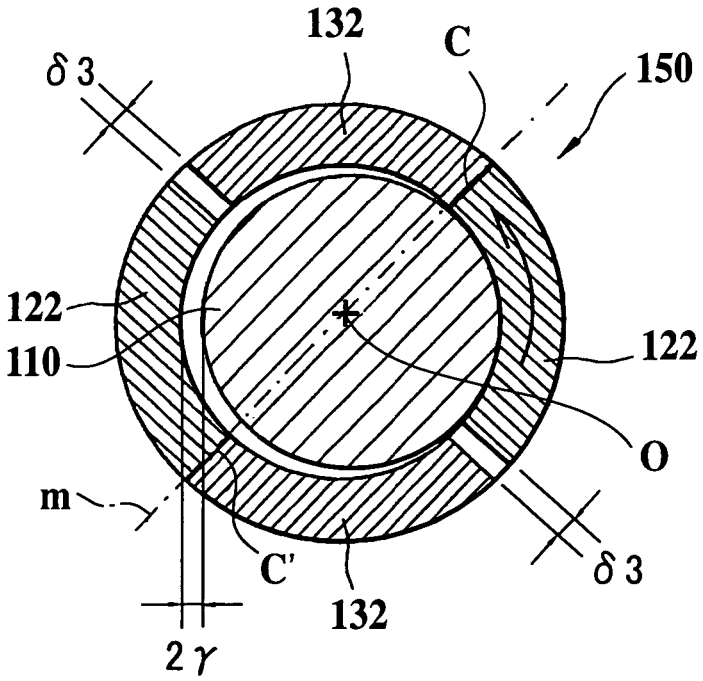
FIG. 7B is a sectional view of the couplings of the second embodiment in a state in which the couplings are engaged and a rotary shaft is slightly rotated counterclockwise.

FIGS. 7A and 7B are sectional views of an earlier technique and another embodiment at a portion of the pawls 122, 132 in a state in which the coupling 150 are engaged.

FIG. 7A is a view of the earlier technique, where γ=0. Hereupon, there is no clearance between the pin 125 and the long hole 124 of FIG. 5B, which is not shown. In FIG. 7A, when the drive section side coupling 120 is slightly rotated counterclockwise with respect to the image bearing body side coupling 130, one pawl 122 at the upper side contacts the pawl 132, however, the other pawl 122 at the lower side is in a state of being separated from the pawl 132, due to variations of positions or processing accuracy. The error at the fixing portions caused by variations of positions or processing accuracy is defined as δ2.

The pawl 122 contacting with the pawl 132 at one point would cause displacement of the rotation center to enlarge the rotation error.

Contrary to this, in FIG. 7B, the drive section side coupling 120 is freely engaged with the rotary shaft 110 keeping the clearance 2γ. The rotary shaft 110 is in a state of being slightly rotated counterclockwise with respect to the drive section side coupling 120. Hereupon, there is no clearance between the pin 125 and the long hole 124 of FIG. 5B, which is not shown. Accordingly, the whole rotation of the rotary shaft 110 is transmitted to the drive section side coupling 120. Also, the pawls 122, 122 contact the pawl 132, 132, respectively. In this embodiment, there is the clearance 2γ satisfying the condition of δ2<2γ between the rotary shaft 110 and the hollow cylindrical portion 121 of the drive section side coupling 120, the pawls 122, 122 can be in contact with the pawl 132, 132 by pressurizing at two points of C and C', respectively.

In FIG. 7B, 2γ is set to be larger than the accumulated amount of parts tolerance of the hole diameter of the drive section side coupling 120 and the diameter of the rotary shaft 110, so that when displacement occurs between the axis centers of the coupling 150 and the rotary shaft 110 in rotation, the two pawls 122 properly contact the pawls 132 at the same time, thereby suppressing rotation error more reliably.

Also, in FIG. 7B, 2γ is set to be larger than the accumulated amount of parts tolerance of the concavities 123 and the pawls 132, so that the pawls 122 properly contact the pawls 132, thereby suppressing rotation error more reliably.

In this embodiment, when rotation is transmitted from the pawls 122 to the pawls 132, as shown in FIG. 7B, it is preferable that the pawls 122 and the pawls 132 are spaced at an angle of 180°, respectively, and when there are two contact surfaces C and C', the contact surfaces C and C', and the central axis O of the coupling 150 are in the same plane. Thereby, the torque of the rotary shaft 110 in the rotation direction is stably and efficiently transmitted from the pawls 122 to the pawls 132, enabling to further reduce rotation error.

Similarly, in FIG. 5A, it is preferable that the shape of the pawls 122 and 132, and the positions thereof in the rotation direction are designed such that the two contact surfaces formed when the pawls 122 contact the pawls 132, and the central axis O of the coupling 150 are in the same plane.

The fixing portion and the fixed portion may be a projection formed on one of the rotary shaft 110 and the drive section side coupling 120, and a concavity formed in the other thereof, respectively. The rotary shaft 110 does not necessarily pass through both of the drive section side coupling 120 and the image bearing body side coupling 130 if it passes through one of them.

In the present invention, it is important that there is allowance at the connection portion of the coupling 150, and the couplings contact with each other at two points. Therefore, in the above embodiment, the long holes 124 and the pin 125 are freely engaged with each other, and the drive section side coupling 120 and the rotary shaft 110 are also freely engaged with each other. However, only one of them may be freely engaged with each other. It may be a combination of the freely engaging structure of the pin 125 and the long holes 124 shown in FIG. 6B, and the freely engaging structure of the pawls 122 and the pawls 132 shown in FIG. 7.

The value of 2γ is preferably within the range of 0.03 to 0.5 mm, more preferably within the range of 0.05 to 0.4 mm. The value of 2γ of less than 0.03 mm would failure in sufficiently counteracting rotation error, and the value of 2γ of over 0.5 mm would failure in following the movement of the rotary shaft 110.

Figure 8:
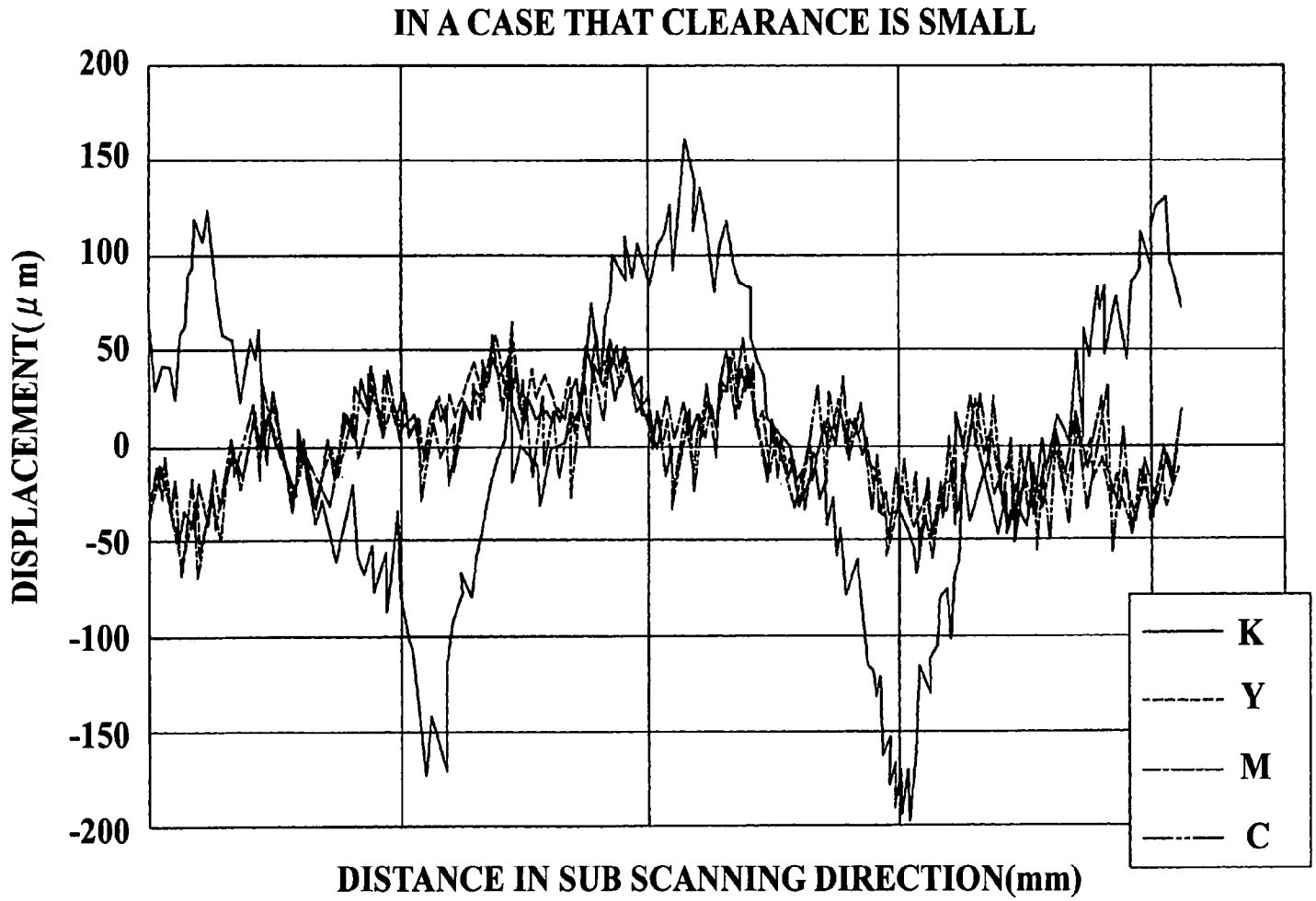
FIG. 8 is a diagram showing a displacement in a case of using the coupling of the present invention for image bearing bodies of yellow (Y), magenta (M), cyan (C) and a coupling of an earlier technique for black (K) having no clearance.

FIG. 8 is a diagram showing a displacement in a case of using two types of couplings shown in FIGS. 5A and 7B for image bearing bodies for three colors of yellow (Y), magenta (M), cyan (C) and a coupling of an earlier technique for black (K) having no clearance. Each clearance δ and δ3 is set be 50 μm. In three colors of Y, M, C for each of which the coupling with a clearance is used, the displacement changes roughly in accordance with one another, and there is almost no difference among the colors. That is, each of the image bearing bodies 1Y, 1M, 1C is successful in following the rotation of the intermediate transfer body 6 within a slight error. Contrary to this, the image bearing body 1K is failure in following the rotation of the intermediate transfer body 6, causing large displacement.

Figure 9:
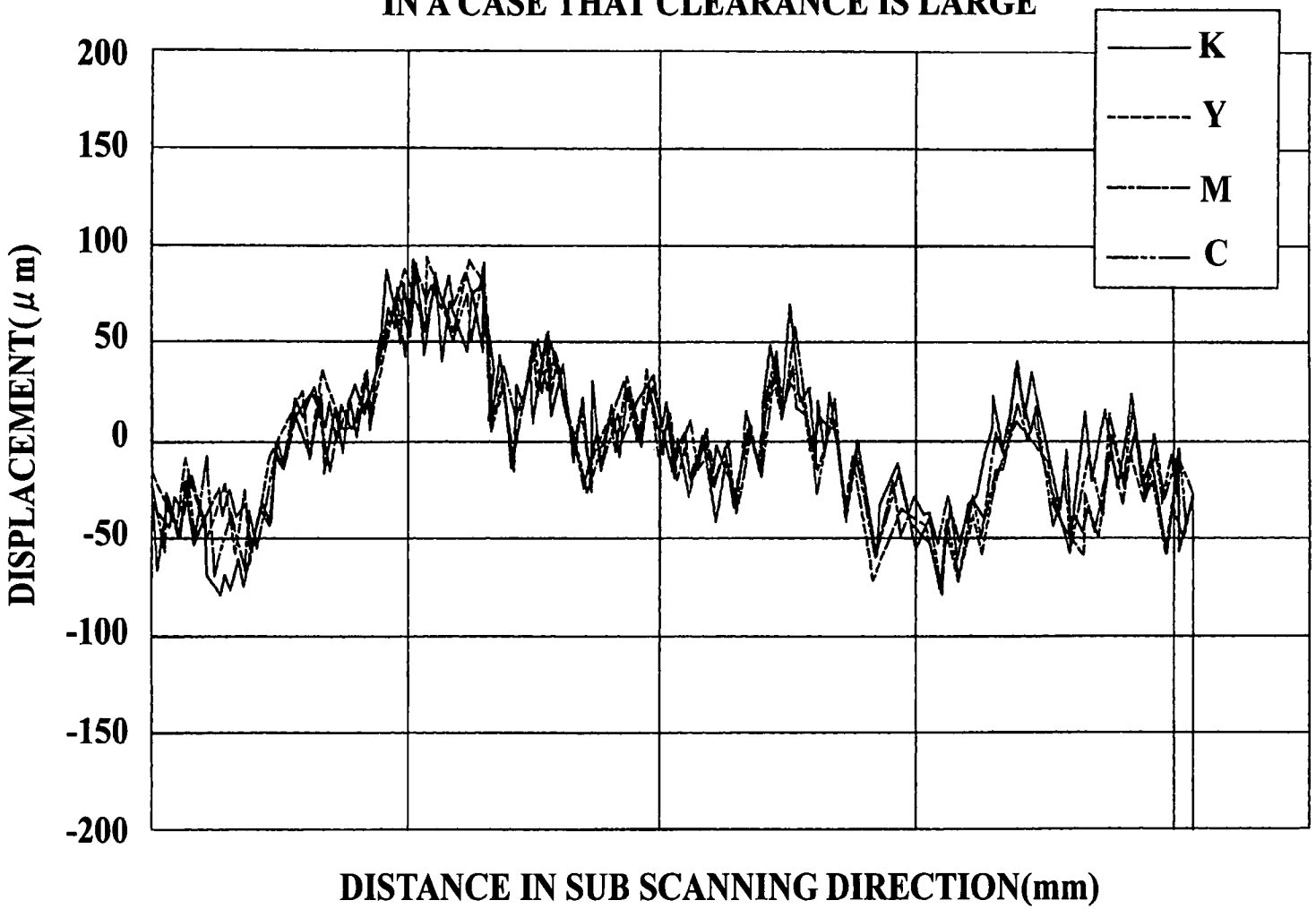
FIG. 9 is a diagram showing a displacement in a case of using the coupling of the present invention for all of the four colors.

FIG. 9 is a diagram showing a displacement in a case of using the coupling with allowance for the image bearing bodies for all of the four colors of Y, M, C, K. It is found that each of the image bearing bodies 1Y, 1M, 1C, 1K for the four colors of Y, M, C, K is successful in following the rotation of the intermediate transfer body 6.

Figure 10A:
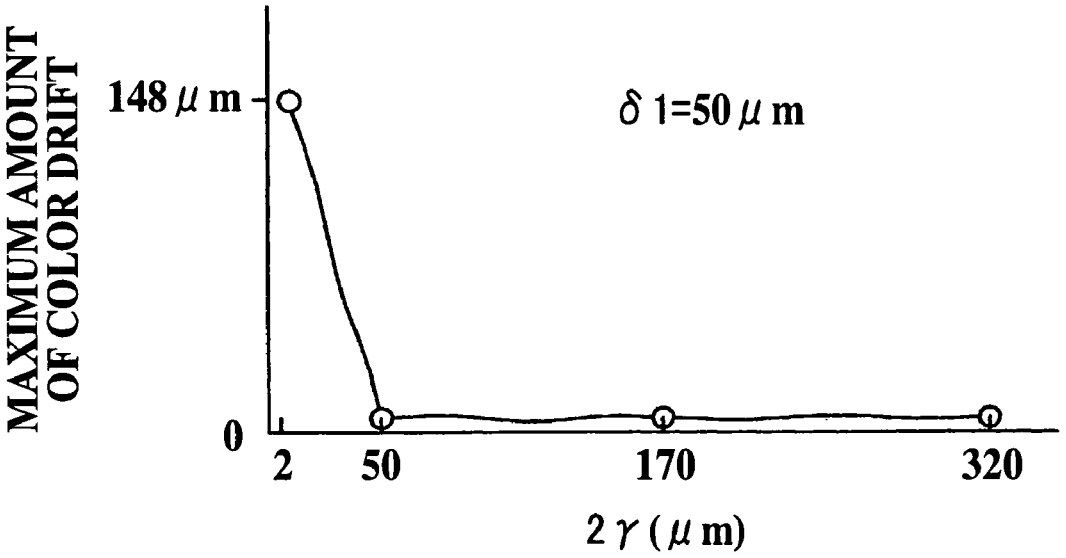
FIG. 10A is a diagram showing a relation between a change of $2\gamma$ and a maximum amount of color drift in a case where $\delta 1=50$ μm.
Figure 10B:
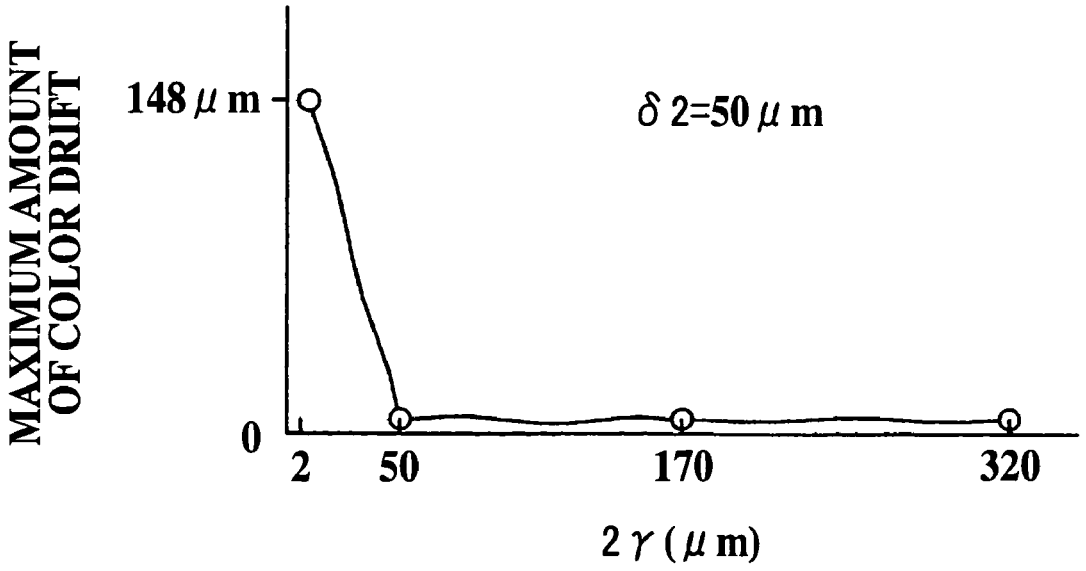
FIG. 10B is a diagram showing a relation between a change of $2\gamma$ and a maximum amount of color drift in a case where $\delta 2=50$ μm.

FIG. 10A is a diagram showing a relation between a change of 2γ and a maximum amount of color drift in a case where δ=50 μm, and FIG. 10B is a diagram showing a relation between a change of 2γ and a maximum color drift in a case where δ3=50 μm. The color drift drastically increases when the value of 2γ is less than 50 μm in both cases, however, the color drift is substantially "0" when the value of 2γ is within the range of 50 μm to 320 μm.

In the above described embodiment, the drive section side coupling 120 has allowance function of the coupling 150, however, concavities may be formed in the image bearing body side coupling 130 corresponding to the long holes 124. But, in view of the difficulty for processing, it is preferable to form concavities in the drive section side coupling 120 as in the embodiment.

Next, the explanation will be made for another embodiment. In this embodiment, the configuration is almost the same as in the first embodiment excluding the configuration of a coupling 180.

Figure 11:
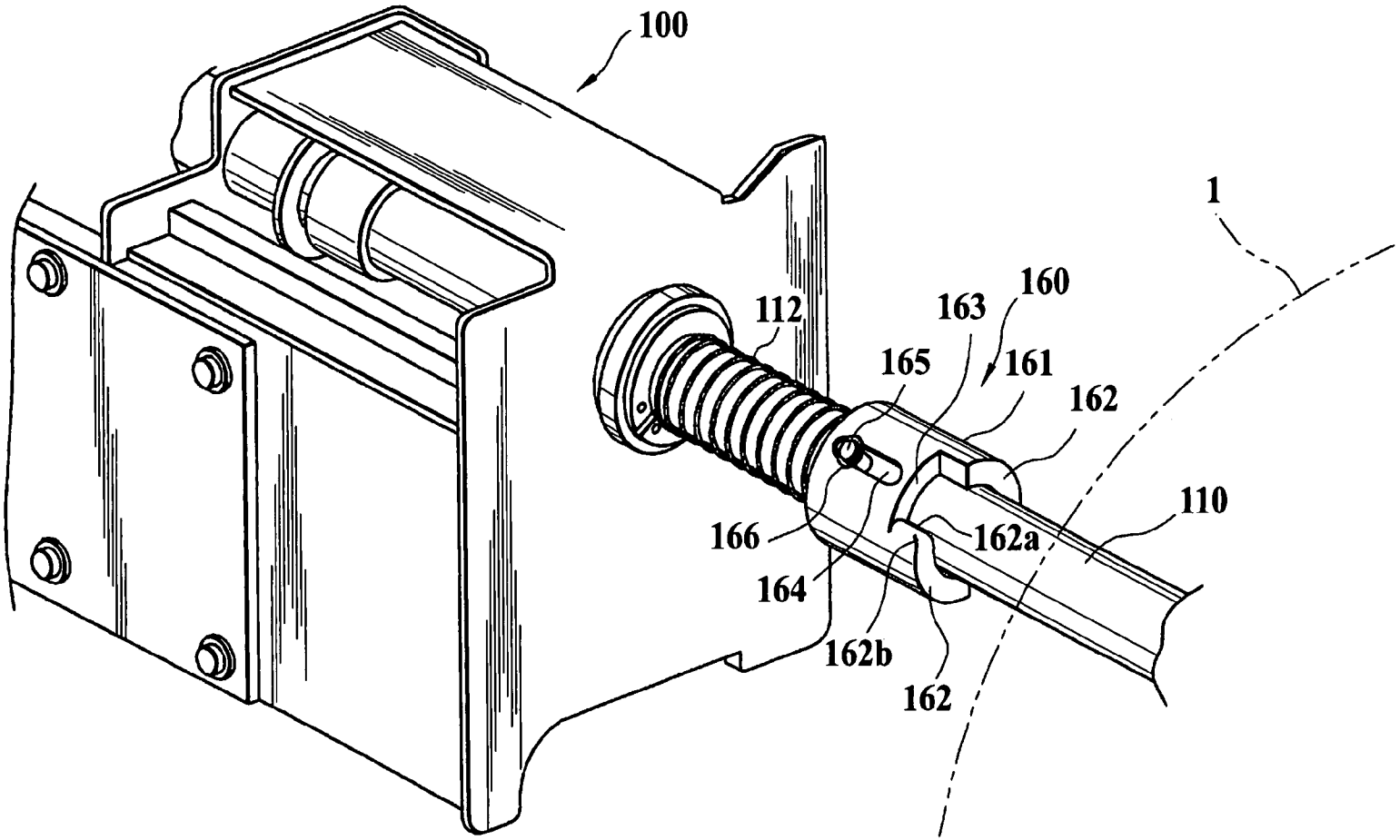
FIG. 11 is a perspective view of a portion from a drive section of an image bearing body to a drive section side coupling of the third embodiment.
Figure 12:
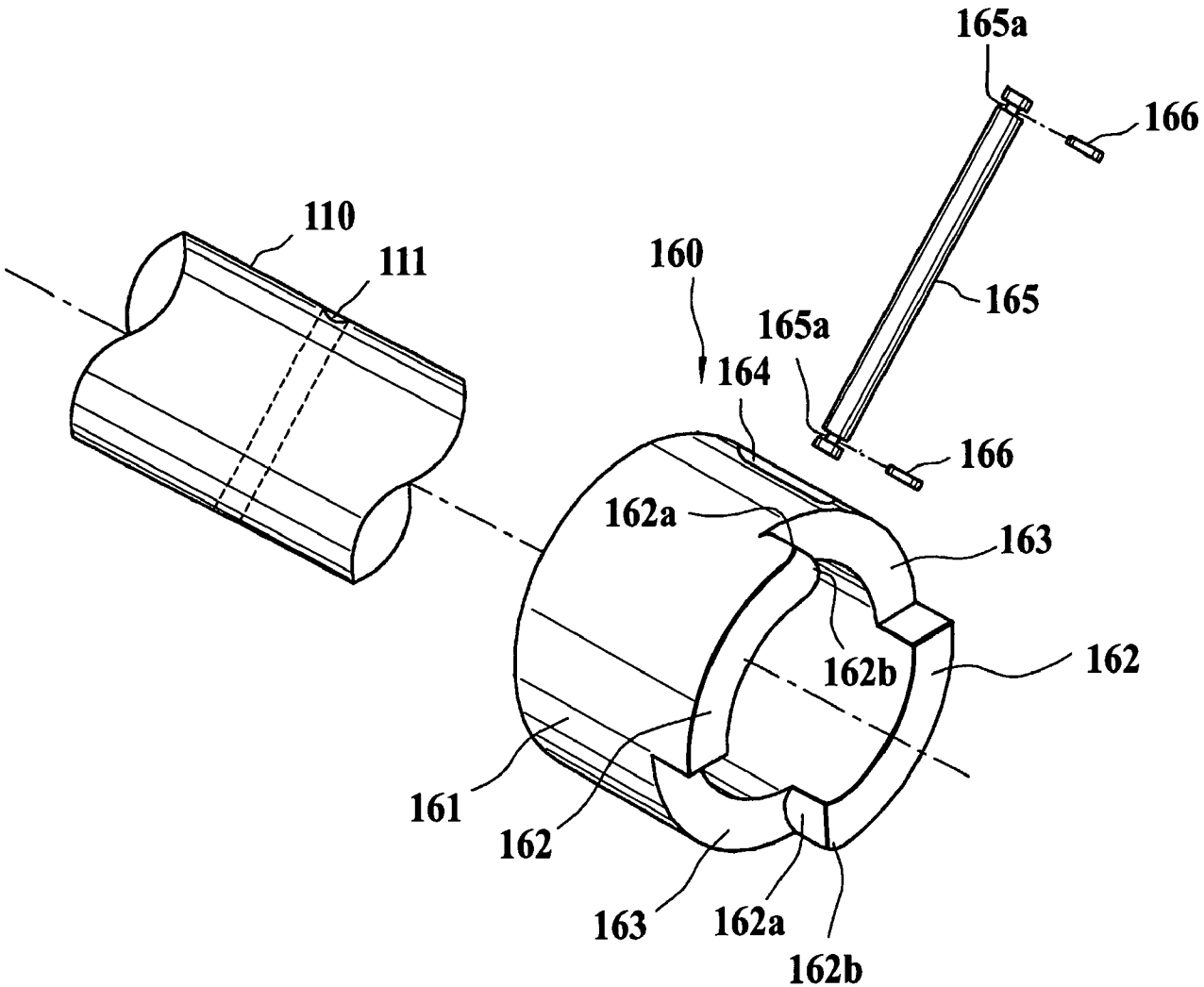
FIG. 12 is a perspective broken view showing a portion around the drive section side coupling of FIG. 11 seen from a different angle.

FIG. 11 is a perspective view of a portion from a drive section of the image bearing body 1 (indicating any one of the image bearing bodies 1Y, 1M, 1C, 1K) to the drive section side coupling. FIG. 12 is a perspective broken view showing a portion around the drive section side coupling of FIG. 11 seen from a different angle. Contained in the drive section 100 is a train of gears or the like, which transmit the rotation which was slowed down to the rotary shaft 110 by the main motor.

A drive section side coupling 160 is attached to the rotary shaft 110. The drive section side 160 is provided at one end of a hollow cylindrical portion 161 two pawls 162, 162 facing each other as convexities, and concavities 163, 163 are provided therebetween. The hollow cylindrical portion 161 is provided with long holes 164 extending in an axis direction to pass through the hollow cylindrical portion 161. A through hole 111 is formed in the rotary shaft 110 to align with the long holes 164. The rotary shaft 110 is inserted from the tip thereof into the drive section side coupling 160 so that the through hole 111 is aligned with the long holes 164. Then, a pin 165 is inserted into the through hole 111 to make both ends of the pin 165 protrude from both sides of the drive section side coupling 160, respectively. The pin 165 is adjusted so that grooves 165*a*, 165*a* at both ends of the pin 165 are approximately equal to the height of the outer peripheral surface of the hollow cylindrical portion 161. Thereafter, E rings 166, 166 are engaged with the grooves 165*a*, 165*a*, respectively, so that the drive section side coupling 160 is engaged with the rotary shaft 110 as shown in FIG. 11.

A coil spring 112 is put on the rotary shaft 110 before inserting the drive section side coupling 160 so that when the drive section side coupling 160 is engaged with an image bearing body side coupling 170, the coil spring 112 is powered to keep the coupling state of both couplings.

Figure 13:
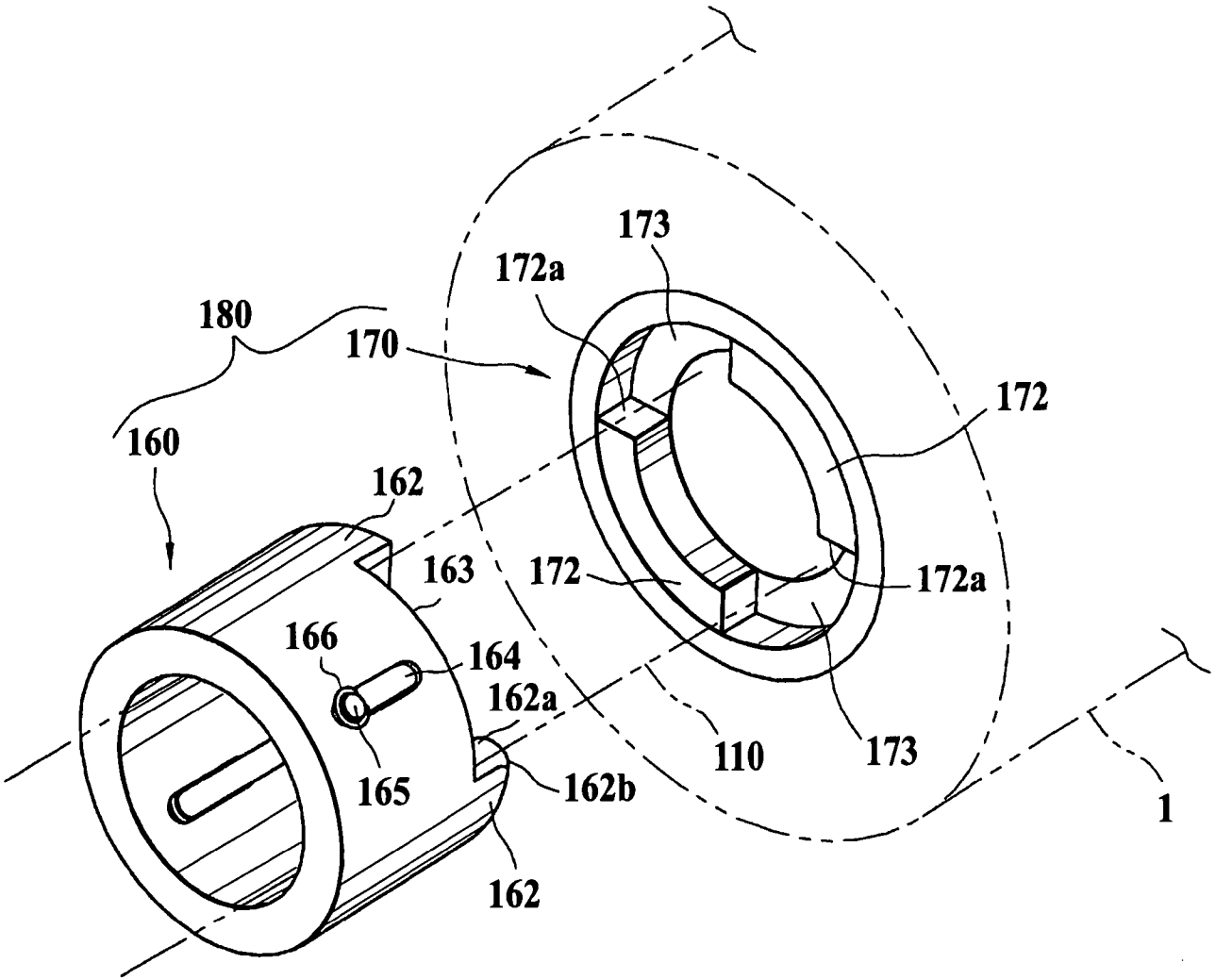
FIG. 13 is a perspective view showing a coupling comprising the drive section side coupling and an image bearing body side coupling before engaged.

FIG. 13 is a perspective view showing a coupling 180 comprising the drive section side coupling 160 and the image bearing body side coupling 170 before engaged. In FIG. 13, the rotary shaft 110 is shown in virtual lines so that the structure of the image bearing body coupling 170 is easily recognized.

The image bearing body side coupling 170 made of metal has a complementary structure of the drive section side coupling 126, and is engaged with the cylindrical shaped image bearing body 1 at both ends thereof to be united. That is, the image bearing body side coupling 170 is provided with two pawls 172, 172 as convexities and two concavities 173, 173 formed therebetween. The pawls 172, 172 are engaged with the concavities 163, 163 of the drive section side coupling 160, respectively, and the concavities 173, 173 are engaged with the pawls 162, 162 of the drive section side coupling 160.

Figure 14A:
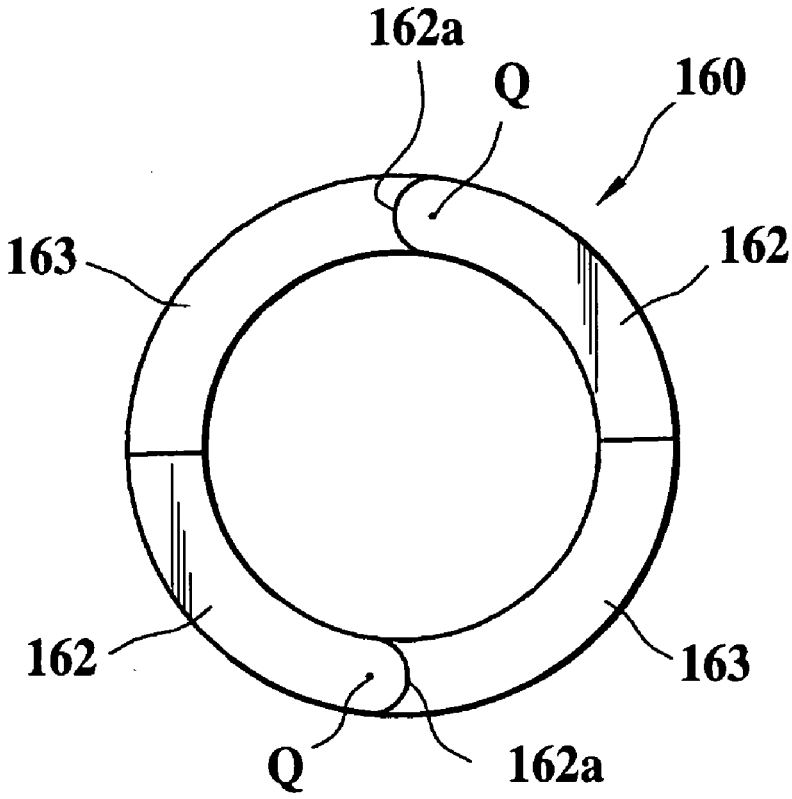
FIG. 14A is a top view of the drive section side coupling.
Figure 14B:
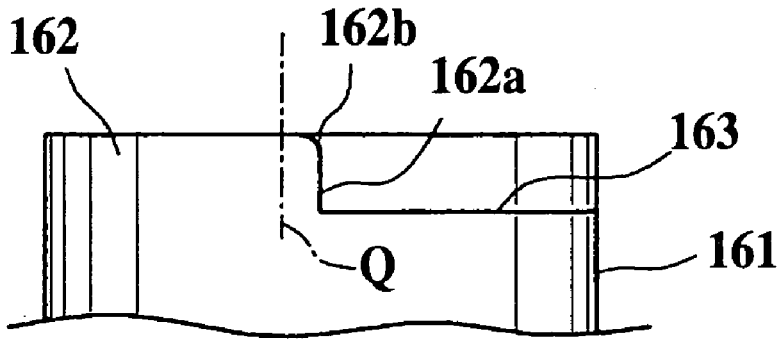
FIG. 14B is a front view of the drive section side coupling.

FIGS. 14A and 14B are views of the drive section side coupling 160. FIG. 14A is a top view, and FIG. 14B is a front view. As shown in FIGS. 12 to 14B, a contact surface 162*a* is formed at the tip side of each pawl 162 in the rotation direction, having a feature that the contact surface 162*a* is formed in a cylindrical shape. A central axis Q of the cylinder formed by the contact surface 162*a* is parallel to a direction in which the couplings coming in contact with or being apart from each other, that is, parallel to the rotary shaft 110. An upper end surface 162*b* of the contact surface 162 is also formed in a cylindrical shape as shown in FIG. 14B. A central axis of the upper end surface 162*b* extends in a direction perpendicular to the central axis Q. In the embodiment shown in the figures, curvature radiuses of the contact surface 162*a* and the upper end surface 162*b* are 5 mm and 2 mm, respectively. Contrary to this, a contact surfaces 172*a* of the pawls 172 of the image bearing body side coupling 170 are flat.

Figure 15A:
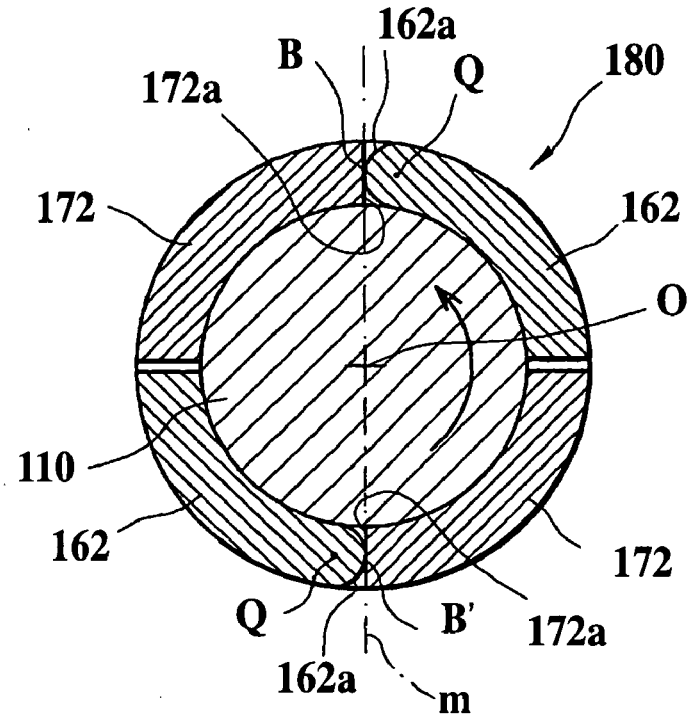
FIG. 15A is a sectional view at a portion of pawls in a state in which the couplings are engaged and rotated, wherein contact surfaces of one of the couplings are formed in a curved shape.
Figure 15B:
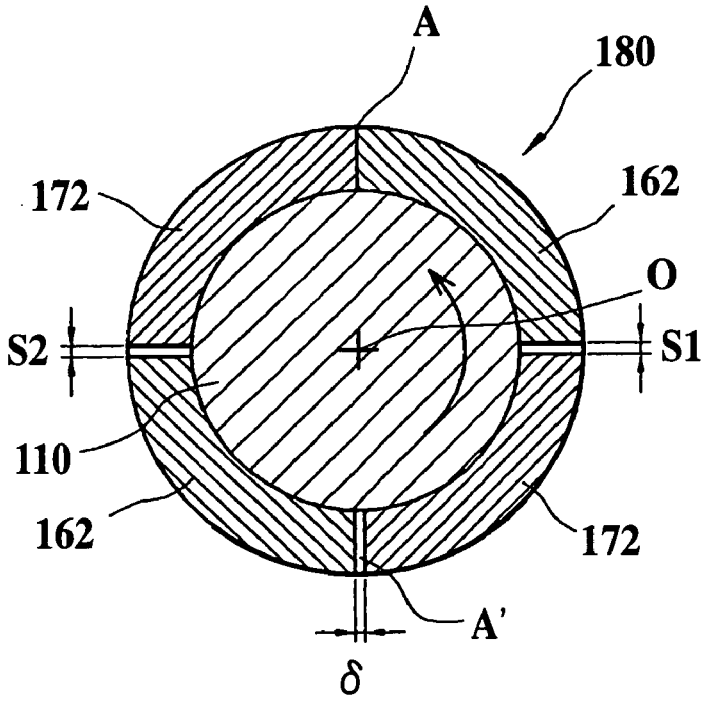
FIG. 15B is a sectional view at a portion of the pawls in a state in which the couplings are engaged and rotated, wherein both of the contact surfaces of the couplings are formed in a flat shape.

FIGS. 15A and 15B are sectional views at a portion of the pawls in a state in which the couplings are engaged and rotated. FIG. 15A is in the case that contact surfaces of one of the coupling are formed in a curved shape, and FIG. 15B is in the case that both of the contact surfaces are formed in a flat shape.

The rotary shaft 110 is inserted into the central hole of the image bearing body side coupling 170 for engaging the coupling 180. The rotary shaft 110 passes through the cylindrical shaped image bearing body 1. Thereafter, one of the rotary shaft 110 and the image bearing body 1 is rotated for engaging the pawls 162 of the drive section side coupling 160 with the concavities 173 of the image bearing body side coupling 170. After engaging the coupling 180, the tip of the rotary shaft 110 protruding from the opposite side of the image bearing body 1 is engaged with a bearing (not shown) provided on a frame for axially supporting the image bearing body 1. The drive section side coupling 160 moves in an axis direction along the long holes 124 by the biasing force by the coil spring 112, enabling the coupling 180 to keep the state of engagement. In the state of engagement, the pawls 162 are engaged with the pawls 172 with no clearance, however, practically, there is a slight clearance formed.

When the rotary shaft 110 is rotated counterclockwise in this state, the tip of the upper right pawl 162 comes into contact with the upper left pawl 172 at point A as shown in FIG. 15A. However, error of location accuracy or processing accuracy of the pawls 162, 172 is not "0", thus, the tip surface of the lower left pawl 162 in FIG. 15B does not contact the lower right pawl 172, thereby generating a slight clearance δ at point A'. Also, a slight clearance S1 is generated between the rear end of the upper right pawl 162 and the lower right pawl 172, and a slight clearance S2 is generated between the rear end of the lower left pawl 162 and the upper left pawl 172. Although these clearances δ, S1, S2 are too small to show, they are enlarged to show in the figures.

The clearances S1, S2 at the rear ends in the rotation direction are generally generated, however, a problem arises in the generation of the clearance δ. The engagement of the pawls 162, 172 of the coupling at only one point would cause displacement of the rotation center to thereby enlarge the rotation error. In the case that the contact surfaces of the pawls 162, 172 of the coupling are both formed in a flat shape, such the one point contact tends to occur.

The rotation center of the image bearing body 1 is different from that of the rotary shaft 110 or the coupling 180 due to a cleaning blade or its own weight. When only one of two transmitting points is used as shown in FIG. 15B, displacement of the rotation center of the image bearing body 1 is caused to thereby deteriorate rotation error.

Contrary to this, the contact surface 162*a* of the tip of each pawl 162 is formed in a curved shape in FIG. 15A. Specially, the central axis Q of the cylindrical surface is parallel to the center O of the rotary shaft 110. Since the contact surface 172*a* of the rear end of each pawl 172 of the image bearing body side coupling 170 is formed in a flat shape, each contact surface 162*a* at the tip of the pawl 162 is in line contact with each contact surface 172*a* of the pawl 172 along a line parallel to the rotary shaft 110. Contact area is small in the case of line contact shown in FIG. 15B compared to the case of surface contact shown in FIG. 15B, the pawls 162, 172 can contact with each other at two points B, B' as shown in FIG. 15A even when a slight error in accuracy or position error exists.

In the above described embodiment, the contact surface 162*a* at the tip of each pawl 162 is formed in a cylindrical surface, however, it may be formed in a spherical surface (hemispherical surface). The spherical surface is successful in being in point contact with the rear end surface 172*a* of the pawl 172, and making the contact area small, enabling the pawls 162, 172 to contact with each other at two points more easily.

Line contact or point contact facilitates elastic deformation of a contact portion to make it easy to contact at two points.

Accordingly, in this embodiment, one of the contact surfaces is formed in a flat shape, and the other thereof is formed in a curved shape, enabling the pawls 162, 172 to contact with each other at the two points B, B'. Thus, the movement of the rotation center is prevented, thereby keeping rotation error small.

It was explained that the contact surfaces 162 are formed in a cylindrical surface, however, it is not limited thereto. But, applying the cylindrical surfaces to make the contact surfaces 162*a* be in line contact with the pawls 172 along a line parallel to the rotary shaft 110 is successful in easily contacting the pawls 162 with the pawls 172 at the two points B, B'. The upper end surfaces 162*b* are not necessarily formed in a curved surface. However, the curved surfaces are successful in making the contact area of the contact surfaces 162*a* small, thereby easily contacting the pawls 162 with the pawls 172 at the two points.

Figure 16:
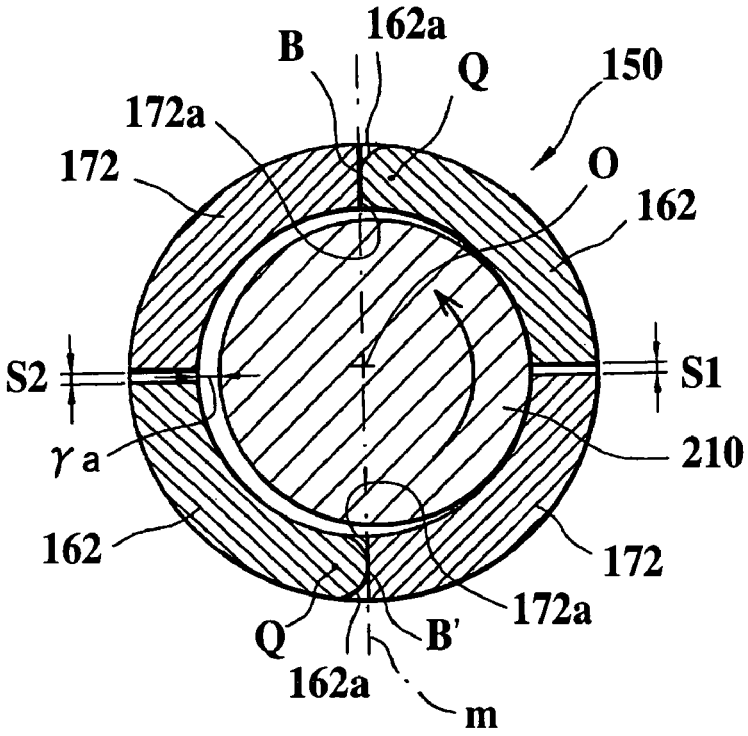
FIG. 16 is a sectional view at a portion of pawls of both couplings of the fourth embodiment.

FIG. 16 is a sectional view at a portion of the pawls 162, 172 of both couplings of another embodiment. In this embodiment, the diameter of a rotary shaft 210 is smaller than that of the drive section side coupling 160, thereby making a slight clearance γa. Slight clearances S1, S2 are formed between the rear ends of the pawls 162, 162 and the pawls 172, 172, respectively. The clearance γa can cause displacement of the centers of the rotary shaft 210 and the drive section side coupling 160 as shown in FIG. 16, enabling the tips of the two pawls 162, 162 to properly contact with the pawls 172, 172 at the two points B, B'.

As in the first embodiment, preferably, the clearance γa is set to be larger than the accumulated amount of tolerance of the outer diameter of rotary shaft 110 and the hole diameter of the coupling 180.

In this embodiment, the contact surfaces 172*a* at the contact portions B, B' that are formed when the pawls 162 contact the pawl 172 are formed in a flat shape as shown in FIG. 16. Preferably, the two contact surfaces 162*a*, 162*a* at the contact portions B, B' and the central axis O of the coupling 180 are in the same plane m. When the number of the pawls is not less than three, there are at least two contact portions, and an extended surface of each contact surface is in the same plane with the central axis O of the coupling 180. Generally, in the case that two contact surfaces are not in the same plane, an extended surface of each contact surface is made to be in the same plane with the central axis O of the coupling 180. The structure is such that the torque in the rotation direction is stably and efficiently transmitted between the drive section side coupling 160 and the image bearing body side coupling 170. Moreover, rotation error can be reduced.

Figure 17:
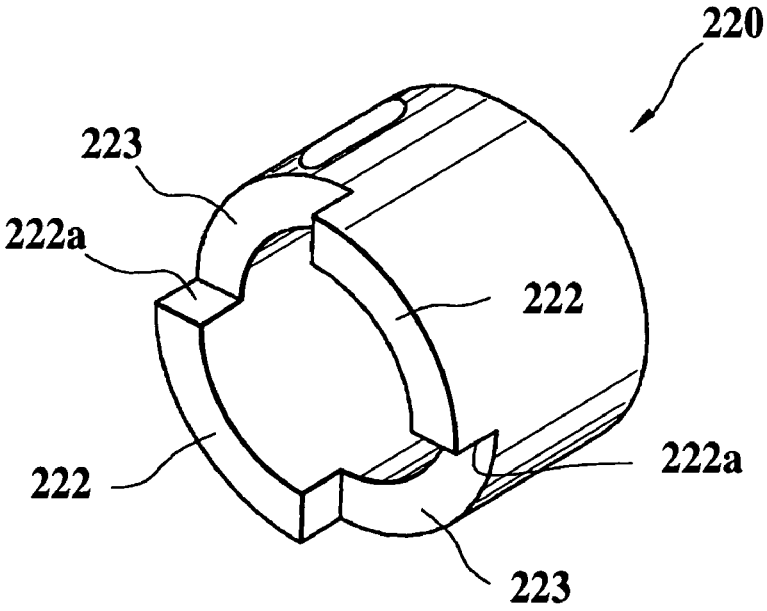
FIG. 17 is a perspective view of a drive section side coupling of the fifth embodiment.
Figure 18:
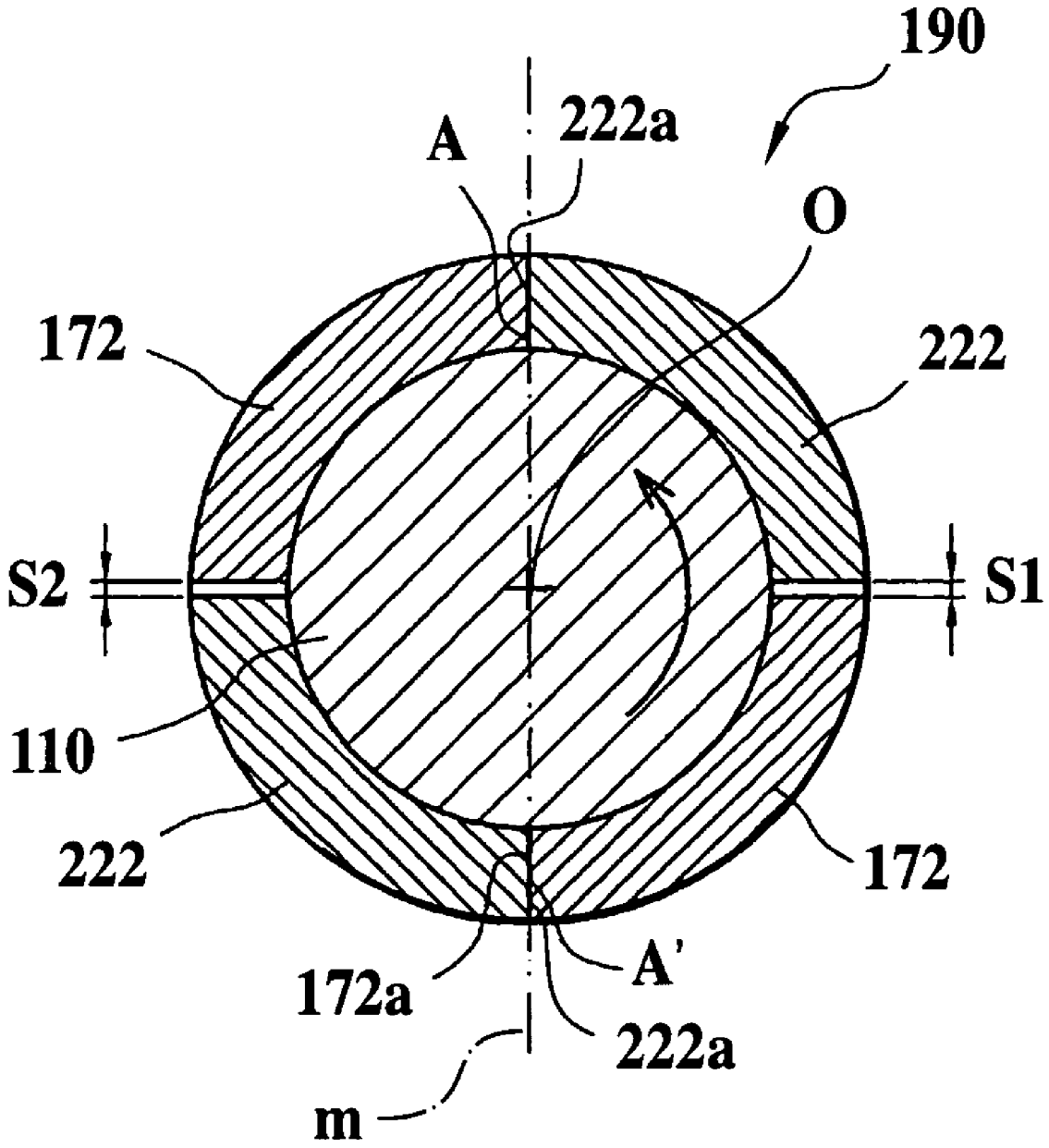
FIG. 18 is a sectional view at a portion of pawls in a state in which the coupling in FIG. 17 is engaged with the other coupling to be rotated.

FIG. 17 is a perspective view showing a drive section side coupling 220 of another embodiment. In this embodiment, the whole drive section side coupling 220 is made of elastic member. The drive section side coupling 220 comprises two pawls 222 and concavities 223. A contact surface 222*a* of the tip of each pawl 222 is not necessarily formed in a curved shape. Since the whole drive section side coupling 220 is made of elastic member, when engaged with the image bearing body side coupling 170 and torqued in a counter-clockwise direction, the contact surfaces 222*a* at the tips of the two pawls 222 can contact with the contact surfaces 172*a* at the rear ends of the pawls 172, respectively, at the same time. That is, if the pawls 222, 172 first came into contact with each other at a point A, the upper right pawl 222 in FIG. 18 is elastically deformed by contact pressure, shortening the length thereof in a peripheral direction. The lower left pawl 222 can perform an extra rotation by this amount, enabling to contact with the contact surface 172*a* at the rear end of the lower right pawl 172 at a point A'.

The clearances S1, S2 are considered to be an amount generated by elastic deformation of the pawls 222, however, it is necessary that this amount is not less than that generated by elastic deformation due to velocity difference between the drive section 100 and the image bearing body 1.

As shown in FIG. 18, the pawls 222 of the drive section side coupling 220 contact the pawls 172 of the image bearing body side coupling 170. In this case, it is preferable that the two contact surfaces 172*a*, 172*a* of the pawls 172 at the contact portions A, A' and the central axis O of a coupling 190 are in the same plane m. The structure is such that the torque in the rotation direction is stably and efficiently transmitted between the drive section side coupling 220 and the image bearing body side coupling 170. Moreover, rotation error can be further reduced.

A slight clearance is generated by making the diameter of the rotary shaft 110 smaller than that of the coupling 190, so that displacement of the centers between the rotary shaft 110 and the coupling 190 can be utilized as in FIG. 16, thereby widening the choices of a material for an elastic member in comparison with the case of properly contacting the pawls with each other only by elastic deformation.

Examples of an elastic material used for the drive section side coupling 220 includes POM (polyacetal resin). In this embodiment, the above mentioned DURAGON (trademark) M90-44 produced by Polyplastic Co., Ltd. is used.

Figure 19:
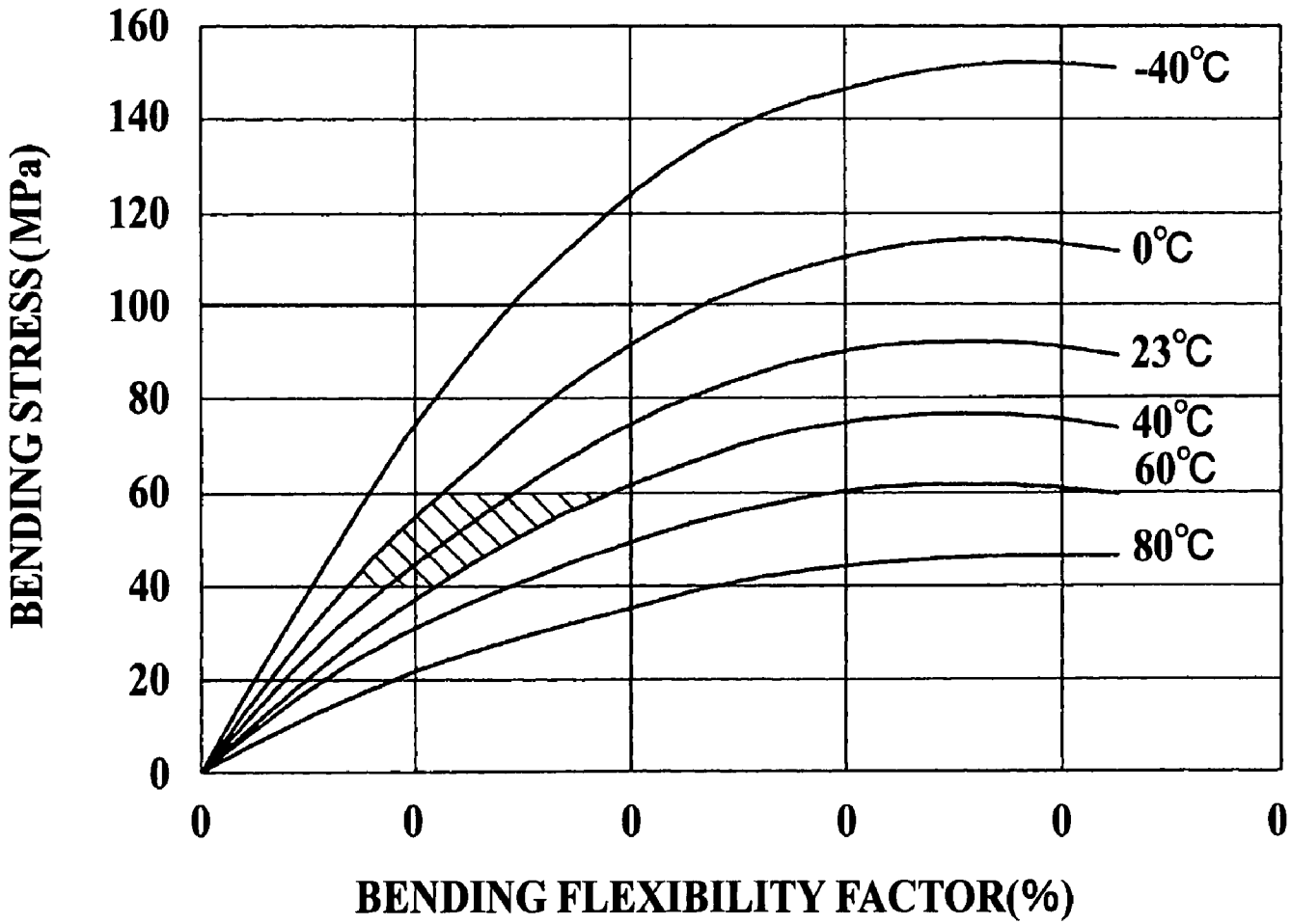
FIG. 19 is a diagram showing relationship between bending stress and bending flexibility factor of DURACON (trademark) M90-44.

FIG. 19 is a diagram showing relationship between bending stress and bending flexibility factor of DURACON (trademark) M90–44, which vary depending upon the temperature of the material. In an image processing apparatus, the operating temperature is 0° C. to 40° C., which is indicated by hatching in FIG. 19. That is, when the bending stress is 40 to 60 Mpa, the bending flexibility factor is within the range of 1.3% to 4%, enabling the pawls to contact with each other at two points. Any material other than those shown in this embodiment may be applicable, provided that the bending stress is within the range of 1.3% to 4% when the bending stress is 40 to 60 Mpa.

The bending stress of 40 to 60 Mpa is a power applied by the drive section to the rotary shaft 110 for driving the image bearing body 1. The bending stress less than 40 Mpa would failure in rotationally driving the image bearing body 1. The bending stress over 60 Mpa would damage peripherals such as the image bearing body 1 per se, a cleaning blade or the like. When the bending flexibility factor is less than 1.3%, elastic deformation of the pawls would be insufficient, thereby failing to contact the pawls with each other at the two points A, A'. When the bending flexibility factor is over 4%, the elastic member is too soft, so that the rotation error may be larger.

Figure 20:
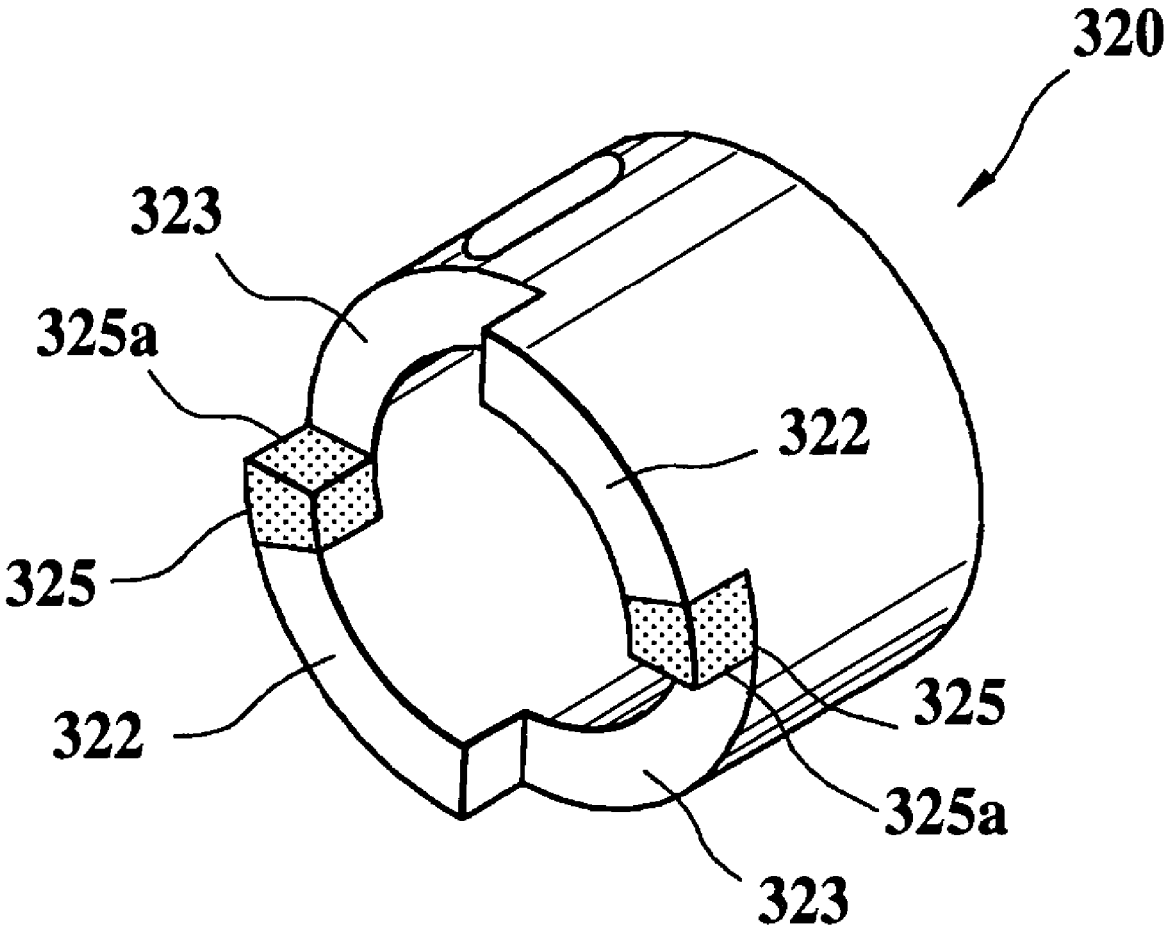
FIG. 20 is a perspective view of a drive section side coupling of the sixth embodiment.

FIG. 20 is a perspective view of a drive section side coupling 320 of further another embodiment. Apparently, the dive section side coupling 320 in this embodiment is same as that in FIG. 17, comprising two pawls 322, 322 and convexities 323, 323 therebetween. The feature of this embodiment is that a chip shaped elastic body 325 is attached to the tip of each pawl 322 in the rotation direction. The elastic bodies 325 are elastically deformed, so that two contact surfaces 325*a* securely contact with pawls. Various kinds of materials can be applied for the elastic bodies 325 by changing the thickness thereof in the rotation direction, however, when considering the elastic body 325 and the pawl 322 as a unit, the bending flexibility factor is to be within the range of 1.3% to 4% in the case that the bending stress is 40 to 60 Mpa.

The elastic bodies 325 contact with the pawls 172 of the image bearing body side coupling 170 as shown in FIG. 18. Preferably, the contact surfaces of the two pawls 172 and the central axis O of the coupling are in the same plane m.

When the image bearing body 1 closely contacts with an image transfer medium such as the intermediate transfer body 6 or the like to perform a toner image transfer, rotation error would easily occur in image bearing bodies in the case of using a coupling of the earlier technique, causing displacement between the image bearing bodies 1 and the intermediate transfer body 6 in the transferring operation, which results in a defective image. In an image forming apparatus for forming black-and-white images, rotation error would occur in the image bearing body 1, resulting in a deflective image.

Contrary to this, in this invention, the above described contact surface 162*a* formed in a curved shape can suppress rotation error in the image bearing bodies 1, so that the image bearing bodies 1 can rotate at the same linear velocity while the image bearing bodies 1 keeping close contact with the intermediate transfer body 6. When forming black-and-white images, the image bearing body 1 can be rotated maintaining a constant velocity. Thus, occurrence of a deflective black-and-white image, or color drift in a color image can be reduced.

In the above structures, example was made where the intermediate transfer body 6 is used as a transfer medium, however, a transfer paper may also be used. Also, example was made where the pawls 162, 222, 322 are engaged with the pawls 172 as contact surfaces, respectively, however, it is not limited thereto.

In the embodiments, the drive section side couplings 160, 220, 320 are formed in a curved shape or have an elastic structure, however, the image bearing body side coupling 170 may be formed in a curved shape or have an elastic structure. However, in view of the difficulty for processing, it is preferable that the drive section side couplings 160 is formed in a curved shape or has an elastic structure.

The entire disclosure of Japanese Patent Application Nos. Tokugan 2003-202328, Tokugan 2003-312375, Tokugan 2004-43817 and Tokugan 2004-43794 which were filed on Jul. 28, 2003, Sep. 4, 2003, Feb. 20, 2004 and Feb. 20, 2004, respectively, including specification, claims, drawings and summary are incorporated herein by reference in its entirety.

What is claimed is:

1. An image frowning apparatus comprising:

a plurality of image bearing bodies on each of which a toner image is formed;

a plurality of drive sections for rotating the plurality of image bearing bodies;

a carrying section for carrying a transfer medium; and a transfer section for superposing each of the toner images farmed on each of the image bearing bodies onto the transfer medium to transfer, wherein each of the drive sections is coupled with each of the image bearing bodies by a coupling comprising a drive section side coupling portion and an image bearing body side coupling portion which are fanned to be engagable with each other, and a clearance 2γ provided between a rotary shaft which transmits a torque from each of the drive sections to each of the image bearing bodies and least one of the drive section side coupling portion and the image bearing side coupling portion is larger than a clearance 2δ provided between a pin which attache, at least one of the drive section side coupling portion and the image bearing side coupling portion to the rotary shaft and side surface of a long hole into which the pin is inserted.

2. An image forming apparatus comprising:

an image bearing body on which a toner image is formed; and a drive section for rotating the image bearing body, wherein the drive section is coupled with the Image bearing body by a coupling comprising a drive section side coupling portion and an image bearing body side coupling portion which arc formed to be engagable with each other, and a clearance 2γ provided between a rotary shaft which transmits a torque from the drive section to the image bearing body and at least one of the drive section side coupling portion and the image bearing side coupling portion is larger than a clearance 2δ provided between a pin which attaches at least one of the drive section side coupling portion and the image bearing side coupling portion to the rotary shaft and side surfaces of a long hole into which the pin is inserted.

3. The apparatus of claim 2, wherein the pin comes into contact with the side surface of the long hole at two points or more at the same time, when transmitting a torque from the drive section.

4. The apparatus of claim 2, wherein one of the drive section side coupling portion and the image bearing side coupling portion comprises a plurality of convexities extending in an axis direction of the rotary shaft, the other thereof comprise a plurality of concavities with which the plurality of convexities are freely engaged, and the plurality of convexities come into contact with the plurality of concavities at two points or more at the same time, when transmitting a torque from the drive section.

5. The apparatus of claim 4, wherein the plurality of convexities form pawls, and the plurality of concavities form gaps between the pawls.

6. The apparatus of claim 4, wherein at least one contact surface at which one off the convexities contact with one of the concavities is formed in a plane which includes a central axis of the coupling, when transmitting a torque from the drive section.

7. The apparatus of claim 4, wherein a central axis of the coupling is included in an extended surface of at least one contact surface at which one of the convexities contact with one of the concavities, when transmitting a torque from the drive section.

8. The apparatus of claim 2, wherein each of the drive section side coupling portion and the image bearing body side coupling portion comprises a hollow cylindrical portion, and the rotary shaft is inserted through each the hollow cylindrical portion.

9. The image forming apparatus of claim 2, wherein at least one of a first contact surface of the drive section side coupling portion which contacts with the image bearing body side coupling portion and a second contact surface of the image bearing body side coupling portion which contacts with the drive section side coupling portion is formed in a curved surface.

10. The apparatus of claim 9, wherein one of the first and second contact surfaces is formed in a curved surface, and the other thereof is formed in a flat surface.

11. The apparatus of claim 10, wherein the curved surface comprises a cylindrical surface or a spherical surface.

12. The apparatus of claim 9, further comprising: a plurality of image bearing bodies; a carrying section for carrying a transfer medium to which toner images formed on the image bearing bodies are transferred; and a transfer section for superposing each of the toner images formed on each of the image bearing bodies onto the transfer medium to transfer.

13. An image forming apparatus comprising:

an image bearing body on which a toner image is formed; and a drive section for rotating the image bearing body, wherein the drive section is coupled with the image bearing body by a coupling comprising a drive section side coupling portion and an image bearing body side coupling portion which are formed to be engagable with each other, and at least one of a first contact portion of the drive section side coupling portion which contacts with the image bearing body side coupling portion and a second contact portion of the image bearing body side coupling portion which contacts with the drive section side coupling portion has an elasticity.

14. The apparatus of claim 13, wherein the drive section side coupling portion and the image bearing side coupling portion comprise a plurality of first and second contact portions, respectively, and the first and second contact portions contact with one another at two points or more, when transmitting a torque from the drive section.

15. The apparatus of claim 13, wherein the at least one of the first and the second contact portions with an elasticity has a bending flexibility factor of 1.3% to 4% when a bending stress is 40 to 60 Mpa.

16. The apparatus of claim 13, wherein the at least one of the first and the second contact portions with an elasticity comprises a polyacetal.

17. The apparatus of claim 13, further comprising: a plurality of image bearing bodies; a carrying section for carrying a transfer medium to which toner images formed on the image bearing bodies are transferred; and a transfer section for superposing each of the toner images formed on each of the image bearing bodies onto the transfer medium to transfer.

18. The apparatus of claim 13, wherein at least one of the drive section side coupling portion and the image bearing side coupling portion is freely engaged with the rotary shalt for transmitting a torque from the drive section to the image bearing body.

19. The apparatus of claim 13, wherein at least one of the drive section aide coupling portion and the image bearing body side coupling portion comprises a hollow cylindrical portion, an inside of which is formed in a hollow cylindrical shape, the rotary shaft is inserted through the hollow cylindrical portion, one of the drive section side coupling portion and the image bearing side coupling portion comprises a plurality of convexities extending in an axis direction of the rotary shaft, the other thereof comprise a plurality of concavities with which the plurality of convexities are freely engaged, the plurality of convexities come into contact with the plurality of concavities at two points or more at the same time when transmitting a torque from the drive section, and a central axis of the coupling is included in an extended surface of at least one contact surface at which one of the convexities is engaged with one of the concavities.

* * * * *